US007322416B2

(12) United States Patent
Burris, II et al.

(10) Patent No.: US 7,322,416 B2
(45) Date of Patent: Jan. 29, 2008

(54) METHODS OF SERVICING A WELL BORE USING SELF-ACTIVATING DOWNHOLE TOOL

(75) Inventors: Wesley J. Burris, II, Flower Mound, TX (US); Kenneth L. Schwendemann, Flower Mound, TX (US); Phillip M. Starr, Duncan, OK (US); Michael L. Fripp, Carrollton, TX (US); John J. Goiffon, Dallas, TX (US); John H. Hales, Frisco, TX (US); John Rodgers, Trophy Club, TX (US); Darrin N. Towers, Carrollton, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 219 days.

(21) Appl. No.: 11/120,220

(22) Filed: May 2, 2005

(65) Prior Publication Data

US 2005/0241824 A1 Nov. 3, 2005

Related U.S. Application Data

(60) Provisional application No. 60/567,743, filed on May 3, 2004.

(51) Int. Cl.
*E21B 43/26* (2006.01)
*E21B 43/263* (2006.01)
*E21B 33/10* (2006.01)

(52) U.S. Cl. ..... 166/308.1; 166/255.2; 166/179; 175/45

(58) Field of Classification Search ..... 166/250.04, 166/255.2, 308.1, 179; 175/45, 24
See application file for complete search history.

(56) References Cited

U.S. PATENT DOCUMENTS 3,225,832 A * 12/1965 Pyle ..... 166/146

(Continued)

OTHER PUBLICATIONS

Patent application entitled "Downhole Tool With Navigation System" by Wesley Jay Burris II, et al., filed May 2, 2005, as U.S. Appl. No. 11/120,266.

(Continued)

*Primary Examiner*—Jennifer H. Gay
*Assistant Examiner*—Shane Bomar
(74) *Attorney, Agent, or Firm*—John W. Wustenberg; Conley Rose, P.C.

(57) ABSTRACT

A method of servicing a well bore comprises deploying into the well bore a zonal isolation device operable to self-set at a sensed location, and self-setting the zonal isolation device to hold at the sensed location without receiving command communications from the surface, wherein the zonal isolation device is deployed along at least a partial length of the well bore via an external force. Another method of servicing comprises deploying into the well bore a tool operable to self-activate at one or more locations, and self-navigating the tool to determine the one or more locations without receiving communications from the surface, wherein the tool is moved along at least a partial length of the well bore via an external force.

11 Claims, 12 Drawing Sheets

U.S. PATENT DOCUMENTS 4,026,363 A 5/1977 Yonker et al.
4,244,424 A 1/1981 Talbot
4,274,489 A 6/1981 Harris
4,299,287 A 11/1981 Vann et al.
4,463,808 A * 8/1984 Mason et al. ..... 166/292
4,756,363 A 7/1988 Lanmon, II et al.
4,790,383 A 12/1988 Savage et al.
4,905,759 A 3/1990 Wesson et al.
4,955,438 A 9/1990 Juergens et al.
5,131,470 A 7/1992 Miszewski et al.
5,163,515 A 11/1992 Tailby et al.
5,284,208 A 2/1994 Clemens et al.
5,293,940 A 3/1994 Hromas et al.
5,381,136 A 1/1995 Powers et al.
5,429,190 A 7/1995 Kilgore et al.
5,613,560 A 3/1997 Jelinski et al.
5,615,172 A 3/1997 Kotlyar
5,850,879 A 12/1998 Smith
5,911,767 A 6/1999 Garibotto et al.
5,947,213 A 9/1999 Angle et al.
6,026,911 A 2/2000 Angle et al.
6,041,860 A * 3/2000 Nazzal et al. ..... 166/250.01
6,059,050 A 5/2000 Gray
6,108,597 A 8/2000 Kirchner et al.
6,112,809 A 9/2000 Angle
6,137,779 A 10/2000 Miller et al.
6,145,378 A 11/2000 McRobbie et al.
6,148,916 A 11/2000 Sampson et al.
6,305,467 B1 10/2001 Connell et al.
6,343,649 B1 2/2002 Beck et al.
6,360,820 B1 3/2002 Laborde et al.
6,360,823 B1 3/2002 Ranson et al.
6,378,627 B1 4/2002 Tubel et al.
6,405,798 B1 6/2002 Barrett et al.
6,411,084 B1 6/2002 Yoo
6,431,270 B1 8/2002 Angle
6,443,228 B1 9/2002 Aronstam et al.
6,446,718 B1 9/2002 Barrett et al.
6,453,239 B1 9/2002 Shirasaka et al.
6,634,425 B2 10/2003 King et al.
6,662,899 B2 12/2003 Norris et al.
6,666,275 B2 12/2003 Neal et al.
6,799,633 B2 10/2004 McGregor
6,843,320 B2 * 1/2005 Yarbro ..... 166/297
7,020,557 B2 3/2006 Reniska
7,055,601 B2 6/2006 Barrow
2002/0145423 A1 10/2002 Yoo
2004/0055746 A1 3/2004 Ross et al.
2005/0072577 A1 4/2005 Freeman
2005/0092363 A1 5/2005 Richard et al.
2005/0133220 A1 * 6/2005 Bishop ..... 166/255.2
2005/0288819 A1 * 12/2005 de Guzman ..... 700/245

OTHER PUBLICATIONS

Patent application entitled "Onboard Navigation System for Downhole Tool" by Wesley Jay Burris II, et al., filed May 2, 2005, as U.S. Appl. No. 11/120,211.
Patent application entitled "Self-Activating Downhole Tool" by Wesley Jay Burris II, et al., filed May 2, 2005, as U.S. Appl. No. 11/120,243.
Office Action dated May 15, 2007 for U.S. Appl. No. 11/120,211 (14 pages).
Office Action dated Jul. 17, 2007 for U.S. Appl. No. 11/120,243 (6 pages).
Office Action dated Feb. 6, 2007 for U.S. Appl. No. 11/120,243 (8 pages).
Office Action dated Mar. 20, 2007 for U.S. Appl. No. 11/120,266 (15 pages).
Office Action dated Oct. 23, 2007 for U.S. Appl. No. 11/120,211 (12 pages).
Office Action dated Aug. 29, 2007 for U.S. Appl. No. 11/120,266 (10 pages).

* cited by examiner

METHODS OF SERVICING A WELL BORE USING SELF-ACTIVATING DOWNHOLE TOOL

CROSS-REFERENCE TO RELATED APPLICATIONS

The present application claims the benefit under 35 U.S.C. § 119(e) of U.S. Provisional Application Ser. No. 60/567,743 filed May 3, 2004 and entitled "Autonomous Navigation for a Downhole Tool," by Wesley Jay Burris II, et al, which is incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present application relates to autonomous downhole tools that are moved in a well bore via an external force, and methods of servicing a well bore using such tools. The present application also relates to autonomous downhole tools that are self-navigating without receiving location communications from an external source, such as from the surface or another downhole component. The present application further relates to autonomous downhole tools that are self-activating without receiving command communications from an external source.

BACKGROUND OF THE INVENTION

A wide variety of downhole tools may be used within a well bore in connection with producing hydrocarbons from a hydrocarbon formation. Downhole tools such as frac plugs, bridge plugs, and packers, for example, may be used to seal a component against casing along the well bore wall or to isolate one pressure zone of the formation from another. In addition, perforating guns may be used to create perforations through casing and into the formation to produce hydrocarbons.

Downhole tools are typically conveyed into the well bore on a wireline, tubing, pipe, or another type of cable. In conventional systems, the operator estimates the location of the downhole tool based on this mechanical connection and also communicates with the tool through this mechanical connection. For example, the operator may send communications to the downhole tool via the cable to command the setting of a plug in the well bore, or to command the firing of a perforating gun. This mechanical connection may be subject to various problems including time consuming and costly operations, increased safety concerns, more personnel on site, and risk for breakage of the connection.

Therefore, a need exists for downhole tools that may be lowered, pumped, or released into the well bore, and that are operable to self-determine their location within the well bore without receiving location communications from the surface. Further, a need exists for downhole tools that are operable to self-activate without receiving command communications from the surface.

SUMMARY OF THE INVENTION

Disclosed herein is a method of servicing a well bore comprising deploying into the well bore a zonal isolation device operable to self-set at a sensed location, and self-setting the zonal isolation device to hold at the sensed location without receiving command communications from the surface, wherein the zonal isolation device is deployed along at least a partial length of the well bore via an external force. In various embodiments, self-setting the device comprises applying hydraulic pressure to the well bore, or releasing energy stored within the device. In various embodiment, the device seals the well bore at the sensed location, or the device seals the well bore after communicating with the surface. In an embodiment, the device is operable to identify the sensed location without receiving location communications from the surface.

In an embodiment, the method further comprises sensing the location of the device within the well bore via an onboard navigation system as the device is being deployed into the well bore, and releasing at least a portion of the onboard navigation system from the set device for retrieval at the surface. In an embodiment, the method further comprises logging properties of the well bore via the onboard navigation system as the device traverses the well bore. In an embodiment, the device is deployed via an external force by pumping the device down the well bore, by dropping the device down the well bore via gravity, by lowering the device down the well bore, or a combination thereof.

In an embodiment, the method further comprises pumping a servicing fluid down the well bore to a location above the set device. In an embodiment, the servicing fluid is a fracturing fluid that enters and fractures a formation via a set of perforations in the well bore. In an embodiment, the method further comprises deploying a perforating gun into the well bore after the device is set, and firing the gun to form the set of perforations. In an embodiment, the perforating gun is deployed by dropping the gun down the well bore via gravity, pumping the perforating gun down the well bore, or a combination thereof. In an embodiment, deployment of the gun is stopped when a spacing component engages both the set device and the perforating gun. In an embodiment, the spacing component projects from the bottom of the perforating gun, and deployment of the gun is stopped in response to contact between the spacing component and the set device. In an embodiment, the spacing component projects from the top of the set device, and deployment of the gun is stopped in response to contact between the spacing component and the gun. In an embodiment, the method further comprises releasing the spacing component into the well bore before deploying the perforating gun into the well bore. In an embodiment, the method further comprises at least partially collapsing, folding, bending, buckling, fragmenting, dissolving, burning away, or combinations thereof the spacer rod during or after firing the gun to lower the gun with respect to the set of perforations.

The method may further comprise deploying into the well bore a second zonal isolation device operable to self-set at a second sensed location above the set of perforations, and self-setting the second device to seal the well bore at the second sensed location. In an embodiment, the second device is operable to identify the second sensed location without receiving communications from the surface. In an embodiment, the method further comprises deploying a second perforating gun into the well bore after the second device is set, and firing the gun to form another set of perforations in the well bore. In an embodiment, the second perforating gun is deployed by dropping the gun down the well bore via gravity, pumping the gun down the well bore, or a combination thereof. In an embodiment, deployment of the second gun is stopped when a second spacing component engages both the second set device and the second perforating gun. In an embodiment, the method further comprises at least partially collapsing, folding, bending, buckling, fragmenting, dissolving, burning away, or combinations thereof the second spacing component during or after firing the second gun to lower the second gun with respect to the another set of perforations. In an embodiment, the method further comprises deploying a perforating gun within the well bore before the device is deployed, and firing the gun to form at least the set of perforations. In an embodiment, the perforating gun is deployed by dropping the gun down the well bore via gravity, by pumping the gun down the well bore, or a combination thereof. In an embodiment, the perforating gun is operable to self-fire at one or more sensed locations. In an embodiment, the perforating gun is operable to identify the one or more sensed locations without receiving communications from the surface.

In an embodiment, the method further comprises releasing the device to unseal the well bore. In an embodiment, the device self-releases without receiving communications from the surface. In an embodiment, the method further comprises returning the device to the surface by floating the device to the surface, flowing the device to the surface, or both. In an embodiment, releasing the device comprises at least partially degrading the device within the well bore. In an embodiment, the method further comprises retrieving the device via a connection to the surface. In an embodiment, the method further comprises fishing the device out of the well bore. In an embodiment, the method further comprises self-setting the device at a desired azimuth orientation. In an embodiment, the method further comprises azimuthally orienting the perforating gun with respect to the set device.

Further disclosed herein is a method of servicing a well bore comprising deploying into the well bore a tool operable to self-activate at one or more locations, and self-navigating the tool to determine the one or more locations without receiving communications from the surface, wherein the tool is moved along at least a partial length of the well bore via an external force. In various embodiments, servicing a well bore comprises servicing a deviated well bore, servicing a lateral well bore, drilling a lateral well bore, or abandoning the well bore.

These and other features and advantages will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description of the figures, taken in connection with the accompanying drawings showing various exemplary embodiments and the detailed description, wherein like reference numerals represent like parts.

DETAILED DESCRIPTION

The present application relates to autonomous downhole tools that are moved at least a partial length along a well bore via an external force. In an embodiment, the autonomous downhole tool is moved along substantially the entire length of the well bore via an external force. In various embodiments, the external force is provided by a cable, by hydraulic pressure, by force of gravity, or by a combination thereof. In an embodiment, the autonomous downhole tool is not self-transportable via an onboard power supply. In an embodiment, the autonomous downhole tool is non-robotic. In an embodiment, the autonomous downhole tool does not provide its own locomotion. In an embodiment, the autonomous downhole tool is not self-propelling. In an embodiment, the autonomous downhole tool does not move within the well bore under its own power. In an embodiment, the autonomous downhole tool does not move within the well bore via traction with the well bore wall. In an embodiment, the autonomous downhole tool does not comprise an operable propeller, wheels or tracks for self-propulsion along the well bore.

In an embodiment, such autonomous downhole tools are self-navigating such that the tool is operable to self-determine its location as it traverses the well bore without receiving location communications from an external source, such as from the surface or another downhole component. In another embodiment, such autonomous downhole tools are self-activating such that the tool is operable to self-activate one or more functions of the tool at one or more locations within the well bore without receiving command communications from an external source.

Figure 1:
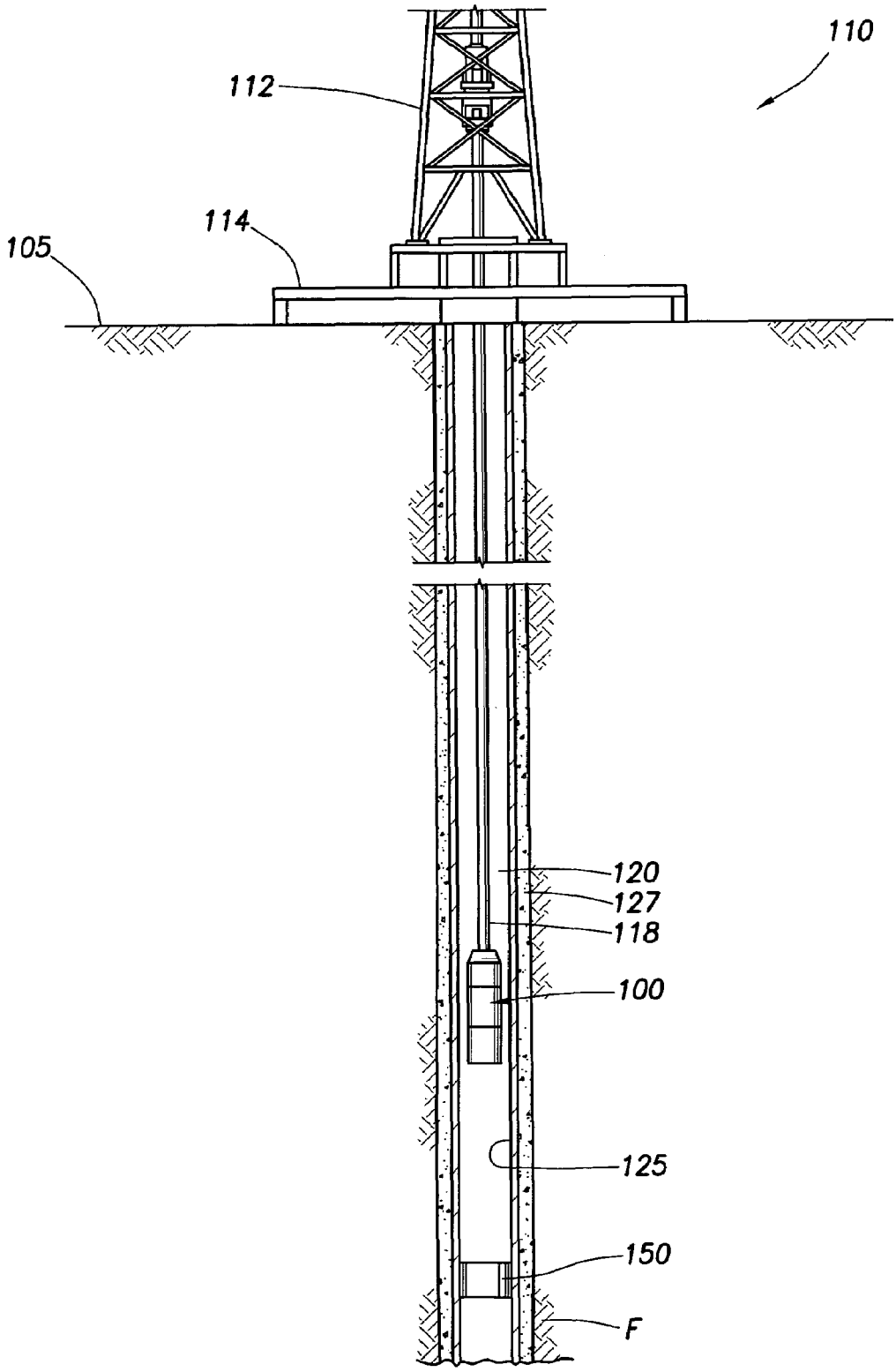
FIG. 1 is a schematic, cross-sectional view of an operating environment depicting an autonomous downhole tool being lowered into a well bore extending into a subterranean hydrocarbon formation.
Figure 2:
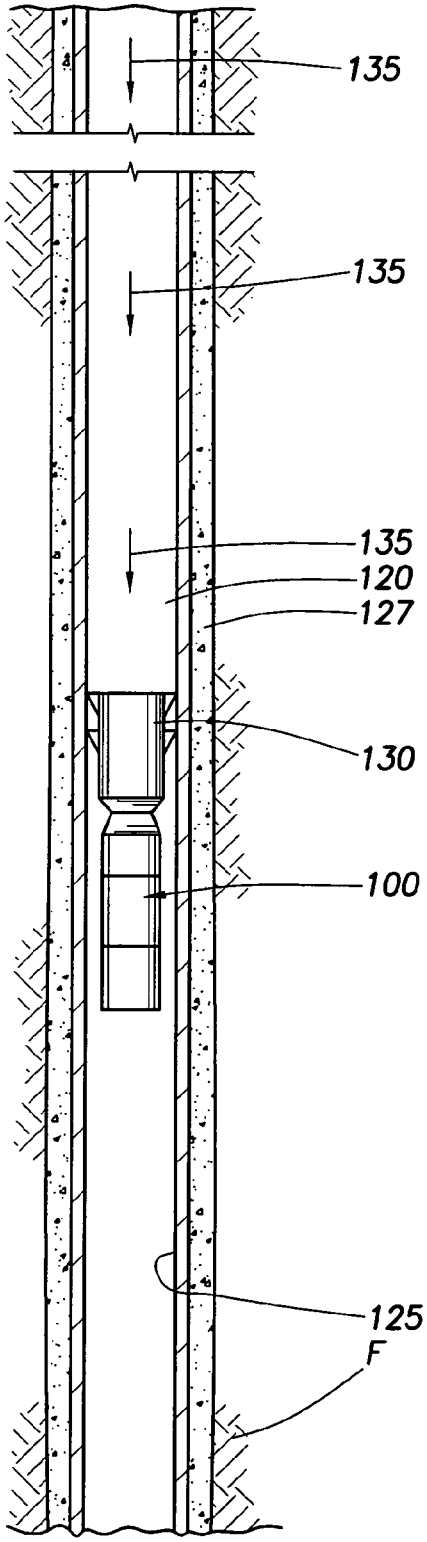
FIG. 2 is a schematic, cross-sectional side view of another operating environment depicting an autonomous downhole tool being pumped into the well bore.
Figure 3:
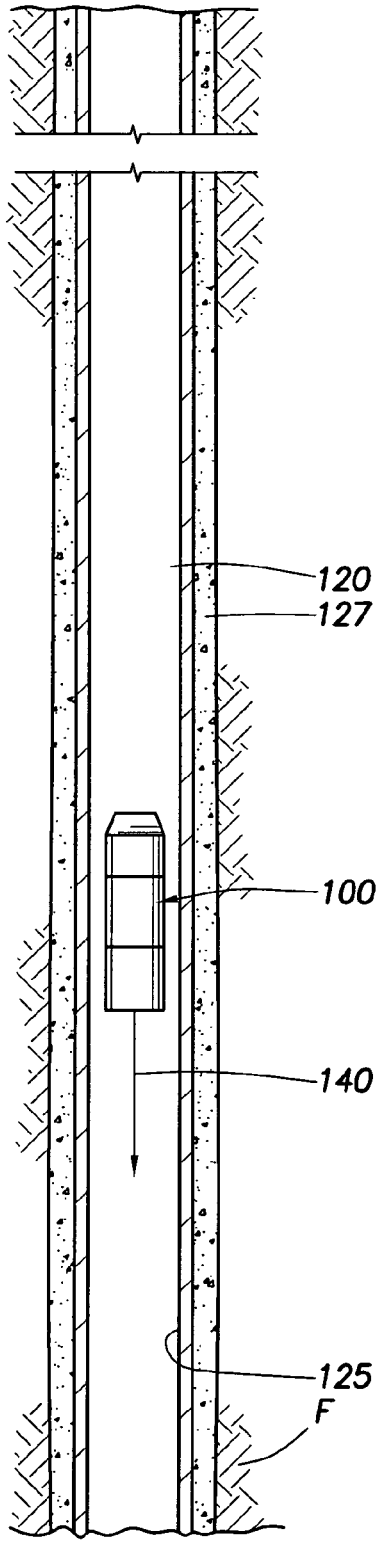
FIG. 3 is a schematic, cross-sectional side view of another operating environment depicting an autonomous downhole tool traversing the well bore by force of gravity.

FIG. 1, FIG. 2, and FIG. 3 each schematically depict various operating environments for an autonomous downhole tool 100 for use in a well bore 120 wherein the autonomous downhole tool 100 is moved along at least a partial length of the well bore 120 via an external force.

Referring to FIG. 1, in a first operating environment, a cable 118 provides the external force for moving the autonomous downhole tool 100 within the well bore 120. In more detail, a drilling rig 110 is positioned on the earth's surface 105 and extends over and around a well bore 120 that penetrates a subterranean formation F for the purpose of recovering hydrocarbons. At least the upper portion of the well bore 120 may be lined with casing 125 that is cemented 127 into position against the formation F in a conventional manner. In embodiments, at least some portions of the well bore 120 may be open hole with no casing 125 installed therein. The drilling rig 110 may include a derrick 112 with a rig floor 114 through which a cable 118, such as a wireline, a slick line, a coiled tubing, or a pipe string, for example, extends downwardly from the drilling rig 110 into the well bore 120. The cable 118 supports and lowers the autonomous downhole tool 100 into the well bore 120 to perform one or more functions. The drilling rig 110 is conventional and therefore includes a motor driven winch or other conveyance and associated equipment for extending the cable 118 into the well bore 120. While the exemplary operating environment depicted in FIG. 1 refers to a stationary drilling rig 110 for lowering the autonomous downhole tool 100 within the well bore 120, one of ordinary skill in the art will readily appreciate that mobile workover rigs, well servicing units, coiled tubing units, and the like, could also be used to lower the tool 100 into the well bore 120.

In an embodiment, the autonomous downhole tool 100 is self-navigating. Namely, the downhole tool 100 is operable to self-determine its location within the well bore 120 as the tool 100 is being lowered by the cable 118. Therefore, the tool 100 does not require location communications from the surface 105 via the cable 118, for example, to determine its location as in conventional systems. As a result, the cable 118 may be deployed at a faster rate. In an embodiment, the autonomous downhole tool 100 is operable to activate one or more functions of the tool 100 at one or more sensed locations in response to command communications received from an external source, such as from the surface 105 via the cable 118 or via wireless communications, for example, or from another downhole component 150.

In another embodiment, the downhole tool 100 is self-activating. Namely, the tool 100 is operable to self-activate one or more functions of the tool 100 at sensed locations within the well bore 120 without receiving command communications from an external source.

Referring now to FIG. 2, in a second operating environment, the autonomous downhole tool 100 may be launched into the well bore 120 via a lubricator (not shown) or simply dropped into the well bore 120. Then hydraulic pressure provides the external force for moving the tool 100 along at least a partial length of the well bore 120. In particular, the autonomous downhole tool 100 comprises an optional wiper 130 that engages and seals against the casing 125 within the well bore 120. A fluid is pumped into the well bore 120, as represented by the flow arrows 135, to force the tool 100 to descend rather than lowering the tool 100 by a cable 118 from the surface 105.

Referring now to FIG. 3, in a third operating environment, the autonomous downhole tool 100 may be launched into the well bore 120 via a lubricator (not shown) or simply dropped into the well bore 120. Then gravity provides the external force for moving the tool 100 along at least a partial length of the well bore 120. In particular, the autonomous downhole tool 100 does not seal against the casing 125. Rather, the tool 100 is simply released into the well bore 120 and descends by free-falling via the force of gravity, as represented by the gravity vector 140, instead of being lowered by a cable 118 from the surface 105, or being pumped down the well bore 120 by a fluid 135.

Although the operating environments of FIG. 1, FIG. 2, and FIG. 3 each depict a single type of external force, as one of ordinary skill in the art will appreciate, the autonomous downhole tool 120 may be moved at least a partial distance along the well bore 120 using a combination of external forces. For example, in another operating environment, the autonomous downhole tool 100 may be conveyed by a cable 118 along a partial length of the well bore 120, then released from the cable 118 and moved along the well bore 120 via hydraulic pressure, force of gravity, or both. In another operating environment, the autonomous downhole tool 100 may be pumped along a partial length of the well bore 120, and then free-fall via gravity along the well bore 120, or vice versa.

Further, the autonomous downhole tool 100 may be moved along the well bore 120 using a combination of external forces and self-locomotion. For example, the autonomous downhole tool 100 may be moved along at least a partial length of the well bore 120 via an external force, such as a cable 118 that does not provide location or command communications to the tool 100, gravity, hydraulic pressure, or a combination thereof, then self-propelled along another length of the well bore 120 using a propeller or tracks that frictionally engage the casing 125.

The autonomous downhole tool 100 may comprise a variety of different forms. By way of example, in an embodiment, the autonomous downhole tool 100 comprises a well bore zonal isolation device, such as a frac plug, a bridge plug, or a packer. A well bore zonal isolation device functions to separate any two areas within a well bore 120. More specifically, such devices separate the area in the well bore 120 above the device from the area of the well bore 120 below the device. In various other embodiments, the autonomous downhole tool 100 comprises a filter, a sand screen, a logging tool, a casing patch, a formation tester, a perforating gun, a whipstock, a marker setting tool, a servicing device for a downhole component, or any other temporary or permanent downhole tool.

In an embodiment, the autonomous downhole tool 100 is a well bore zonal isolation device or a perforating gun that is moveable along at least a partial length the well bore 120 via an external force and has a communication line connected thereto from the surface 105. The communication line is operable to provide communications to and from the zonal isolation device or the perforating gun in the well bore 120. In an embodiment, the communication line is non-supportive of the device or the perforating gun in the well bore, in contrast to the cable 118 described herein, which has the ability to support the entire tool 100 as it is conveyed into or retrieved from the well bore 120.

Figure 4:
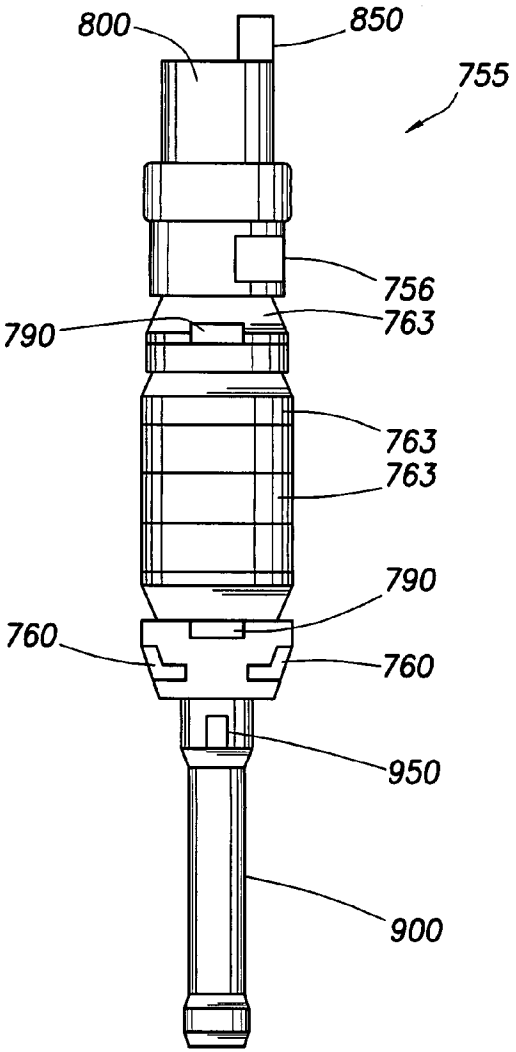
FIG. 4 is a schematic representation of an autonomous downhole tool.

The autonomous downhole tool 100 may in various embodiments comprise a variety of different components and functionalities. FIG. 4 schematically depicts an autonomous downhole tool 755 comprising one or more of the numbered components. In an embodiment, the autonomous downhole tool 755 comprises a navigation system 756. In an embodiment, the autonomous downhole tool 755 comprises one or more functional components 763, which may include a braking system 760. In an embodiment, the autonomous downhole tool 755 comprises one or more activators 790 operable to activate the one or more functional components 763 of the tool 755, including the braking system 760. In an embodiment, the autonomous downhole tool 755 comprises a detachable component 800. In an embodiment, the autonomous downhole tool 755 further comprises a spacing component 900, shown coupled to the bottom thereof for positioning the autonomous downhole tool 755 with respect to a feature in the well bore 120.

The navigation system 756 operably connects to the autonomous downhole tool 755 to provide a determination of the location of the tool 755 as it traverses the well bore 120. By way of example, an operable connection may be provided by a mechanical, electrical, hydraulic or wireless connection between two components, such as the navigation system 756 and the tool 755. In general, the navigation system 756 senses at least one parameter and determines the location of the tool 755 within the well bore 120 based on the sensed parameters. Specifically, the navigation system 756 determines the absolute location of the tool 755 within the well bore 120 relative to a known reference, such as a well bore feature, a formation feature, a surface feature, a global positioning system (GPS), or a combination thereof. In an embodiment, the navigation system 756 locally determines the location of the tool 755 within the well bore 120 without receiving location communications from the surface 105. In an embodiment, the navigation system 756 determines the location of the tool 755 within the well bore 120 based on parameters sensed within the well bore 120. In an embodiment, the navigation system 756 is further operable to determine an azimuth orientation of the tool 755 within the well bore 120.

Figure 5:
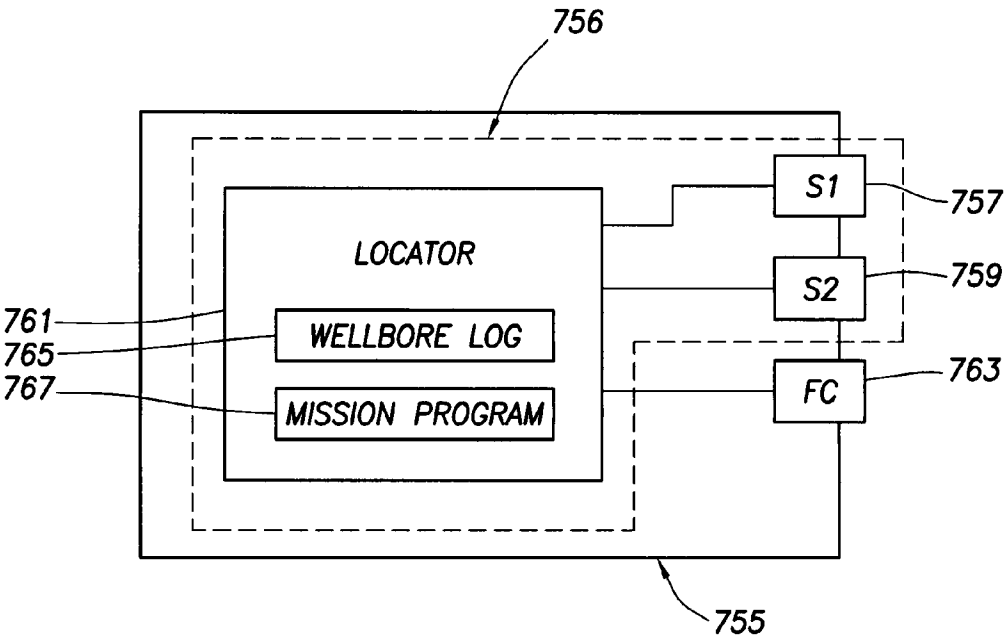
FIG. 5 is a block diagram of a downhole tool comprising a navigation system and at least one functional component.

In more detail, FIG. 5 is a block diagram of the autonomous downhole tool 755 comprising an exemplary onboard navigation system 756 and at least one functional component 763. In an embodiment, the onboard navigation system 756 comprises a first sensor 757 operable within the well bore 120 to sense a first parameter, a second sensor 759 operable within the well bore 120 to sense a second parameter, and a locator component 761. While two sensors are illustrated in FIG. 5, it should be understood that a single sensor or a plurality of sensors, including three or more sensors, may be used. The first sensor 757 and the second sensor 759 provide the sensed parameters to the locator component 761. The locator component 761 then uses the sensed parameters to determine a location of the tool 755 within the well bore 120. The locator component 761 may further comprise a well bore log 765 and a mission program 767. In various embodiments, the locator component 761 may provide a trigger signal to the functional component 763 based on the mission program 767, on the location of the tool 755 within the well bore 120, on another metric derived from the location of the tool 755, such as a velocity of the tool 755, or combinations thereof. The locator component 761 may be a computing component, such as a circuit board having a CPU, memory, and desired connectivity and communication interfaces and functionality. While the locator component 761 of FIG. 5 is positioned onboard the tool 755, in an alternative embodiment, the locator component 761 is operably connected to the sensors 757, 759 and may be positioned at the surface 105 or within another downhole component 150. Such a locator component 761 may communicate with the tool 755 via wireless communications (e.g. electronic signals, acoustic signals, or pressure pulses generated in a fluid flowing into the well bore 120); via a non-supportive communication line, or via other known communication means. Examples of non-supportive communication lines include microtubing, microwire, microfiber, fiber optics, and the like.

The first sensor 757 is operable within the well bore 120 to sense a corresponding first parameter, for example a structure of the well bore 120, such as a casing collar (e.g., a casing collar locator), a formation characteristic (e.g., a gamma/neutron profile), a pipe marker, a coded pipe marker, an electrical impedance or a magnetic characteristic of the well bore casing 125, a pipe inside surface characteristic, a geometry of the pipe, a well bore deviation, or other feature of the well bore 120, well bore casing, or lithologic formation surrounding the well bore 120. In an embodiment, the first sensor 757 may be classified as a structured-environment type sensor since it is directed to sensing features of a structured environment. In alternative embodiments, other types of sensors as described herein may be selected as each of a plurality of sensors (e.g., a first sensor, second sensor, etc.).

The first sensor 757 is operably connected to the locator component 761, and the locator component 761 analyzes the first parameter provided by the first sensor 757. The locator component 761 compares the first parameter to a corresponding first reference standard, for example the well bore log 765. By comparing the first sensed parameter to a first reference standard, the locator component 761 is able to determine the location of the tool 755 within the well bore 120. The determination of the location of the tool 755 based on the first sensed parameter and on a first reference standard may be referred to as a first location estimate. The first location estimate may be termed a discrete or quantized metric of the location of the tool 755 because the values of the first location estimate are confined to the values associated with the first sensed parameter and the corresponding first reference standard, for example casing collar locations, and may exclude other locations that lie between.

In an embodiment wherein the first sensor 757 is a structured-environment type sensor that senses coded pipe markers, the coded pipe markers may provide specific location, position, or displacement information, which reduces errors of calculating or determining the location of the tool 755. The information is encoded in each coded pipe marker. The first sensor 757 reads the coded information, and the locator component 761 decodes the information and uses the information to determine the location of the tool 755 within the well bore 120. In an embodiment, the first sensor 757 may decode the information and provide the locator component 761 with location information. Additional well bore intervention may be required to generate and to position these coded pipe markers during well construction or during separate post-construction serving operations.

In another embodiment, the pipe markers sensed by the first sensor 757 may be uncoded. A plurality of uncoded markers may be used as an alternative to casing collars for determining the location of the tool 755, either in a simple counting algorithm, or with a more complex mapping scheme. Widely spaced markers, either coded or uncoded, may identify key positions in the well bore 120. The widely spaced markers may also provide an additional error correction check in a conventional collar locator based system. Uncoded markers may be more easily detected than magnetically detected casing collars. Such markers may detect mechanical internal diameter changes, changes in the dielectric permittivity, and changes in the dielectric permeability, for example, and may be magnetic, optical, radiological, or combinations thereof.

In an embodiment, the reference standard is a well bore log 765, for example a well bore log 765 previously created with imaging software. The well bore log 765 may be created during logging of the cased well bore 120, or alternatively, each segment of pipe could be logged prior to placement in the well bore 120. In alternative embodiments, the image of the casing 125, such as a casing detail that records interior surface variations of the casing pipe, may be made with an optical sensor, magnetic sensor, a gamma/neutron sensor, or any other sensor that can repeatably measure variations in the pipe or the formation F. Optical imaging identifies key landmarks such as irregularly spaced perforations, drill pipe cuts, slip marks, or distinct geometric features, such as the horizontal lines generated by a collar gap spacing in a casing segment. Magnetic imaging identifies variations in the magnetic field of the pipe.

The well bore log 765 created with imaging software may be compressed using known techniques to reduce the bandwidth, the memory, and/or the computing requirements to use the well bore log 765. The well bore log 765 may be used in combination with object recognition software to match the sensed parameters to the identifying characteristics of the imaged well bore 120 contained in the well bore log 765, thereby providing an indication of location of the tool 755 within the well bore 120. Signal processing may also be applied to improve the quality of the data from the sensed parameters provided to the object recognition software.

In one embodiment, the first sensor 757 may be a casing collar locator (CCL) sensor, such as a curb feeler CCL or a giant magnetoresistive (GMR) CCL, and the well bore log 765 may be a cased-hole log. A casing collar is a thickening of an end of the casing pipe to provide for threaded connections between pipes. Each joint or segment of casing pipe includes two casing collars, one casing collar at either end of the casing pipe. The combination of two casing collars where two segments of casing pipe connect, one casing collar on either segment of casing pipe, is commonly referred to hereinafter as a casing collar. The curb feeler CCL may measure force, strain, sound, acceleration, or combinations thereof as the curb feeler CCL physically interferes with the gap between passing collars. The curb feeler CCL may be a wiper plug or a simple metal strip dragging against the casing wall.

Suitable GMR-CCLs are disclosed and described in U.S. Pat. No. 6,411,084 to Yoo, and U.S. patent application Publication No. US2002/0145423 A1 to Yoo, both of which are owned by the assignee hereof, and are herein incorporated by reference for all purposes. In other embodiments, alternate GMR-CCL designs may be employed. In an embodiment, the first sensor 757 may be a CCL that comprises a magnetic or capacitive proximity sensor that drags along the casing wall and indicates gaps that may correspond to the connection between two casing segments.

The well bore log 765 provides information defining the length of each segment of casing pipe and the relative positions of each segment of casing pipe in a particular well bore. The well bore log 765 may consist of a sequence of numbers representing the length of each segment of casing pipe wherein the sequence of the numbers is directly associated with the sequence of the segments of casing pipe—for example, the first number is the length of the first segment of casing pipe which is located at the top of the well, the second number is the length of the second segment of casing pipe which is attached below the first segment of casing pipe, the third number is the length of the third segment of casing pipe which is attached below the second segment of casing pipe, and so on. An alternative well bore log 765 format may include additional information in a file structured into a plurality of records or lines, wherein each record or line contains information about one segment of casing pipe. Each record may comprise a number of fields such as a length field containing a number representing the length of the segment of casing pipe, a sequence field containing a number representing the sequential position of the segment of casing pipe, a diameter field containing a number representing the diameter of the segment of casing pipe, and, optionally, additional fields containing other information. These and other formats known to those skilled in the art are contemplated for use as the well bore log 765 by this disclosure.

The locator component 761 will analyze the output of the first sensor 757 to determine that a casing collar has been located. By counting the casing collars that the tool 755 encounters as it traverses the well bore 120, the locator component 761 may determine the position of the tool 755 within the well bore 120 based on the well bore log 765. For example, when the first casing collar is sensed by the first sensor 757, the locator component 761 determines that the tool 755 has traversed the length of the first casing segment into the well bore 120, which is looked up by referencing the well bore log 765. When the second casing collar is sensed by the first sensor 757, the locator component 761 determines that the tool 755 has traversed the length of the first casing segment plus the length of the second casing segment into the well bore 120, which is looked up by referencing the well bore log 765, and so on. While the discussion of the cased-hole log type of well bore log 765 and the determination of the first location estimate above was directed to an embodiment employing the first sensor 757, other embodiments employing alternative structured-environment type sensors and alternative reference standards may be used in a similar manner to determine the first location estimate. The locator component 761 may also compare the well bore log 765 with the sequence of well bore structures, for example casing collars, detected as the tool 755 traverses the well bore to match up a pattern of structure indicated in the well bore log 765 to a pattern of structure detected by the locator component 761. This may provide a corroboration of structure detection which may be used to correct structure detection errors.

In an embodiment the well bore log 765 contains a count of casing segments in the well bore and an assumed casing segment length. The first location estimate is then determined based on adding the assumed collar segment length to the previous first location estimate when a collar location is detected. Alternately, the locator component 761 may determine the location of the tool 755 entirely in terms of casing segment sequence number. For example, the tool 755 may be programmed to deploy into the well bore 120 and self-activate along the $200^{th}$ casing segment. In another embodiment, the locator component 761 does not contain a well bore log 765, but instead counts collar detection events as the tool 755 traverses the well bore, and commands the tool 755 to self-activate upon reaching a collar count specified in the mission program 767.

The first location estimate may be subject to various errors. For example, the indication provided by the first sensor 757 may be weak or indefinite, and consequently the locator component 761 may not count a structural feature or other sensed parameter, and the association of the location of the tool 755 to the reference standard such as the well bore log 765 may be offset. For example, if the casing segments are each forty feet long and the casing collar corresponding to casing segment number 40 is missed, the locator component 761 may determine the first location estimate to be 1560 feet instead of 1600 feet—having failed to add in the 40 foot length of a segment of casing pipe. An alternate error is to mistakenly count a structural feature before it has been encountered as the tool 755 traverses the well bore, for example spuriously counting a casing collar because of a noise spike in the indication from the first sensor 757.

The second sensor 759 is operable in a well bore 120 to sense a corresponding second parameter. The first sensor 757 and the second sensor 759 may be the same or different. In an embodiment, the second sensor 759 senses a parameter that is derived from and/or integrated with the first sensor 757, for example a timer (i.e., the second sensor 759) responsive to a casing collar locator (i.e., the first sensor 757).

In an embodiment, the second sensor 759 is different from the first sensor 757. For example, in various embodiments, the second sensor 759 comprises an absolute, relative, or cumulative type sensor. Absolute type sensors rely on sensing physical parameters that are independent of any well structures. Examples of absolute type sensors include a sensitive gravity gradient sensor, a hydrostatic pressure sensor, or a fixed length line attached to an onboard line spool. Relative type sensors determine distance to reference points. Examples of relative type sensors include range-finding to surface, range-finding to bottom, range-finding to a passive secondary device, and range-finding to an active synchronized pinging source employing acoustic (e.g., time-of-flight), ultrasonic, radio frequency, and optical energy. Cumulative type sensors count total time and/or distance from the surface and accumulate error along the way, termed dead reckoning. Examples of cumulative type sensors include flow meters which track fluid passage, inertial integration sensors (e.g., integration of acceleration data to estimate position), pipe tracking using either a physical contacting tracking device such as a wheel counter (i.e., odometry) or an optical or magnetic tracking device, a timer, or a constant velocity timing sensor.

The second sensor 759 is operably connected to the locator component 761, and the locator component 761 compares the second sensed parameter to a reference standard to determine a second location estimate. The reference standard used to determine the second location estimate may be the same as the first reference standard (e.g., a well bore log 765) or may be another (i.e., second) reference standard corresponding in type to the second sensed parameter.

In an embodiment, the second location estimate may be termed a continuous metric of the location of the tool 755 because the value that the second location estimate may take corresponds to any point along the well bore (in contrast to discrete increments or intervals), to the extent and resolution permitted by the numerical representation system employed by the locator component 761. For example, whereas the first location estimate based on the indication of structure provided by the first sensor 757 may take successive values of about 40 foot increments (e.g., 40.37 feet, 79.57 feet, 120.17 feet, and so on), the second location estimate based on the indication of the location of the tool 755 provided by a hydrostatic pressure sensor may take multiple values and values at non-discrete increments: 40.37 feet, 40.40 feet, 40.43 feet, . . . , 52.00 feet, 52.03 feet, 52.06 feet, . . . , 79.51 feet, 79.54 feet, 79.57 feet, and so on. Because the second location estimate is continuous, in the sense described above, the second location estimate may be employed to extrapolate the location of the tool 755 beyond a discrete location determination of the first location estimate, prior to reaching a subsequent discrete location determination of the first location estimate. The second location estimate may be subject to various errors, depending upon the second sensor 759. For example, a hydrostatic pressure sensor produces an indication of increasing hydrostatic pressure in the well bore as the tool 755 descends further into a vertical well bore 120 filled with fluid. The locator component 761 determines the second location estimate based on the indication of hydrostatic pressure from the hydrostatic pressure sensor 759 as compared to a reference standard (e.g., a map, functional relationship, or equation) of the hydrostatic pressure to the location of the tool 755 in the well bore 120. This reference standard may assume that the fluid density is constant, such that variations of the fluid density cause error in the second location estimate. Other errors may be associated with the absolute, cumulative, and relative sensor types and their corresponding reference standards.

In an embodiment, the second sensor 759 may comprise one or more accelerometers or inertial sensors. In this embodiment, inertial indications may be integrated with respect to time, either by the locator component 761 or within the second sensor 759, to produce an indication of the location of the tool 755 in a 6-axis system. The 6-axis location includes position in a XYZ-coordinate system as well as yaw, pitch, and roll rotations about these axes.

The locator component 761 may determine a velocity of the tool 755 traversing the well bore 120 by dividing a location displacement by a time interval. The location displacement may be determined based on successive values of the first location estimate, the second location estimate, or combinations thereof. The time interval may be determined from a clock internal to the locator component 761 or from a separate timer component within the tool 755. The locator component 761 may use the velocity of the tool 755 to determine the correct location to trigger deployment of a brake to slow the tool 755 sufficiently to activate the functional component 763. For example, if the tool 755 is traversing the well bore 120 at a relatively high velocity, the locator component 761 may determine to trigger the deployment of the brake 50 feet before the location desirable for activating the functional component 763 whereas if the tool 755 is traversing the well bore 120 at a relatively slow velocity, the locator component 761 may determine to trigger the deployment of the brake 25 feet before the location desirable for activating the functional component 763.

In an embodiment, the first sensor 757 and the second sensor 759 are identical sensors, or they sense an identical parameter, or both, also referred to as diversity sensors. In various embodiments, the diversity sensors 757, 759 may be arranged radially, circumferentially, axially, or combinations thereof about the tool 755. Where the diversity sensors 757, 759 are arrayed axially, a lower sensor would be expected to sense a common parameter at a time earlier than an upper sensor as the tool 755 traverses the well bore 120. The difference in time readings between the lower and upper sensors may be correlated to the velocity of the tool 755 traversing the well bore 120. Thus, a sensed parameter may be attributed to noise or other sensing error if there is not a corresponding time differential between the sensing of the parameter by the diversity sensors 757, 759. Where the diversity sensors 757, 759 are arrayed circumferentially or radially, the diversity sensors 757, 759 would be expected to read a commonly sensed parameter at about the same time. Thus, a sensed parameter may be attributed to noise or other sensing error if a time differential occurs between the sensing of the parameter by the diversity sensors 757, 759. Furthermore, a radial array assists corrections for the tool being off-centered in the well bore 120. A radial array can also help to distinguish radially symmetric well bore features, such as collars, from other anomalies, such as perforations.

The amount of error in the first location estimate and the second location estimate may vary depending upon the type of sensor employed to determine the location estimate. For example, the location estimation error associated with the structured-environment type sensors is different from the error associated with the absolute, cumulative, and relative type sensors, and this difference may be used by the locator component 761 to reduce the overall error in estimating the location of the tool 755 in the well bore 120. The error associated with the structured-environment type sensors is a discrete or quantum error. For example, when using the first sensor 757, missing a collar may introduce an error equivalent to a length of casing, e.g., 40 feet, into the first location estimate. The error associated with the absolute, cumulative, and relative sensor types is a continuous error and is typically a small error over a small displacement along the well bore 120—for example a few inches over 160 feet—but may become large over the length of a well bore 120, for example several yards over 16,000 feet.

Figure 6:
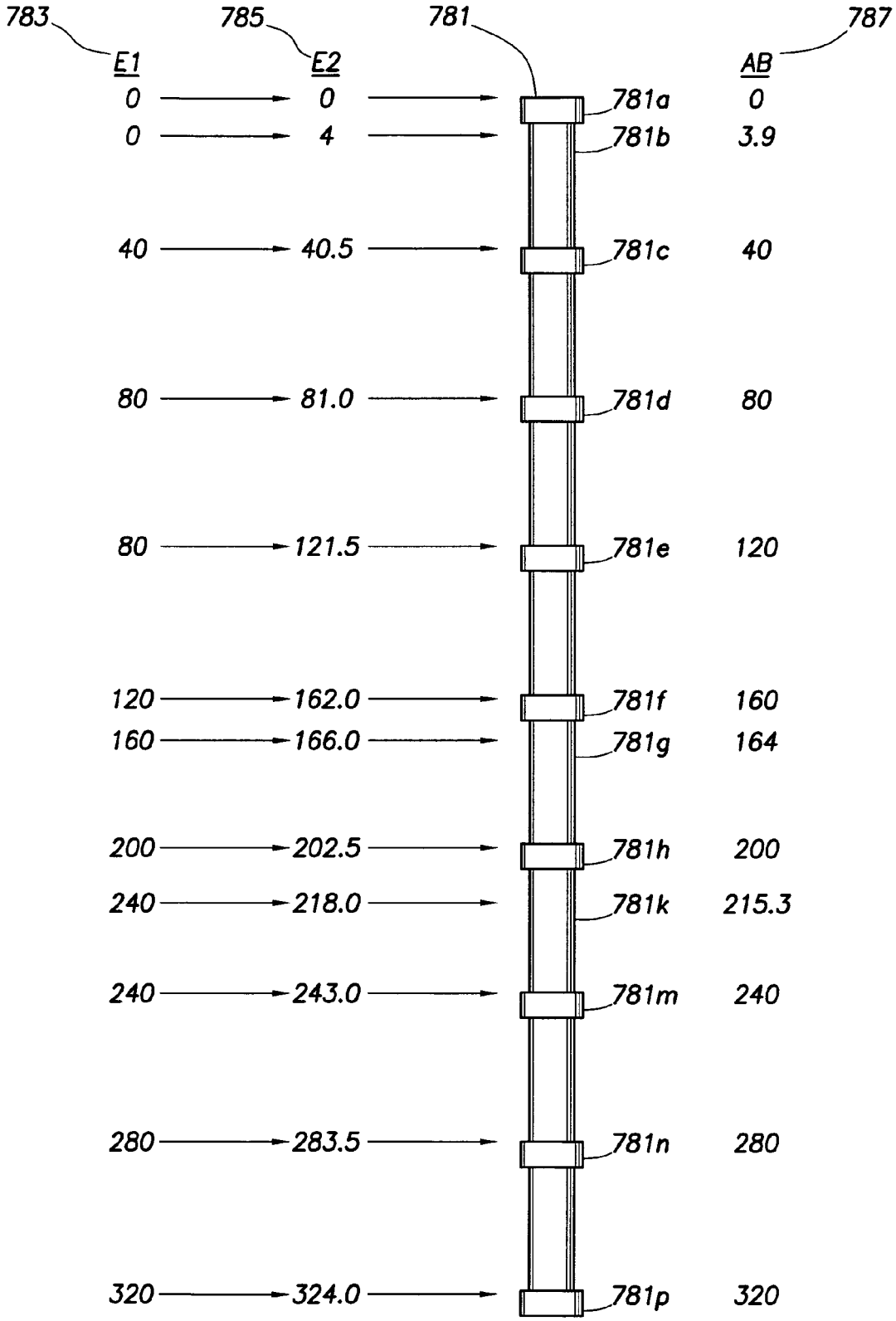
FIG. 6 depicts a casing string indicating absolute location, a first location estimate, and a second location estimate at several points along the casing string.

Turning now to FIG. 6, a diagram of an exemplary casing string 781 is shown for depicting the two types of errors discussed above and how the first location estimate may be used to correct the second location estimate and vice versa. For convenience, the casing string 781 comprises eight segments of pipe connected serially, with the understanding that longer lengths of casing are typically employed. For purposes of this example, each segment of casing pipe is assumed to be exactly forty feet long and such information is captured in the well bore log 765. The E1 column 783 indicates the first location estimate at various locations of the tool 755 as it moves into the well bore 120. The E2 column 785 indicates the second location estimate at various locations of the tool 755 as it moves into the well bore 120. The AB column 787 indicates the absolute location of the tool 755 as it moves into the well bore 120.

In this embodiment, the first sensor 757 is a CCL sensor and the second sensor 759 is a continuous sensor, such as a cumulative distance meter. At a first string location 781*a* the absolute location, the first location estimate, and the second location estimate listed in the AB column 787, the E1 column 783, and the E2 column 785, respectively, are all 0. At a second string location 781*b*, the second location estimate shown in the E2 column is 4 feet. The second location estimate is continuous as the tool 755 traverses the well bore 120 and cumulative along the entire length of the casing string 781. At the second string location 781*b*, the first location estimate remains unchanged at 0 feet because the first sensor 757 has not detected a casing collar.

At a third string location 781*c*, the first and second casing segments connect at a casing collar. When the tool 755 arrives at the third string location 781*c*, the locator component 761 analyzes the first sensor 757 sensed parameter to detect a casing collar and adds the length of the casing segment, indicated by the well bore log 765 to be forty feet, to the first location estimate of 0 to provide an updated first location estimate of 40 feet. To the extent that the well bore log 765 is accurate, the first location estimate is accurate at the third string location 781*c*.

Also at the third string location 781*c*, the second sensor 759 indicates a depth of 40.5 feet. Thus, an error of 0.5 feet has developed in the second location estimate. While this error is small, an error of 0.5 feet per casing segment grows to 50 feet of error after the tool 755 traverses 100 casing segments, a distance of approximately 4000 feet. Since the first location estimate is accurate, the locator component 761 could correct the second location estimate to equal 40 feet, for example by resetting the second sensor to zero. This is an example of using the first location estimate from the first sensor 757 to correct or to recalibrate an erroneous second location estimate from the second sensor 759. Additionally, the first location estimate could be used to re-estimate the change in voltage with respect to depth of the second sensor 759.

At a fourth string location 781*d*, the first location estimate is incremented by the locator component 761 to 80 feet, and the second location estimate is determined by the locator component 761 to be 81.0 feet. At a fifth string location 781*e* the casing collar locator sensor 757 fails to detect the casing collar located at the fifth string location 781*e*, and hence the first location estimate remains unchanged at 80 feet, which is an error of 40 feet. The second location estimate from the second sensor 759 is 121.5 feet.

At a sixth string location 781*f*, the first location estimate is incremented by the locator component 761 to 120 feet, and the second location estimate is determined by the locator component 761 to be 162.0 feet. At the sixth string location 781*f*, the second location estimate of 162.0 feet could be used by the locator component 761 to deduce that the casing collar at the fifth string location 781*e* was overlooked. While the locator component 761 may expect some error in the second location estimate, an error of 40 feet in the second location estimate is not plausible given the nature of the error expected for the second sensor 759. The plausible explanation is that the casing collar at the fifth string location 781*e* was overlooked, and the first location estimate should be adjusted to account for the casing collar at the fifth string location 781*e* and the sixth string location 781*f*. This is an example of using the second location estimate to correct the first location estimate, which may be referred to as corroborating the first location estimate.

At a seventh string location 781*g*, the locator component 761 erroneously detects a casing collar and increments the first location estimate in the E1 column 783 to 160 feet. Assuming that a correction has not already been made, the erroneous or spurious detection of a casing collar compensates for the earlier erroneous failure to detect a casing collar at the fifth string location 781*e*. The double counting of collars, i.e., the spurious detection of casing collars, typically does not exactly balance the skipped counting of collars, and the error tends to increase proportionally to the square root of the number of collars measured.

At an eighth string location 781*h*, the locator component 761 correctly detects a casing collar and increments the first location estimate to 200 feet. At a ninth string location 781*k*, the locator component 761 erroneously detects a casing collar and increments the first location estimate to 240 feet. The locator component 761 determines the second location estimate at the ninth string location 781*k* to be 218 feet. The second location estimate is in error versus the absolute location of 215.3 feet, but is accurate enough to conclude that the detection of the casing collar is spurious and hence that the locator component 761 should disregard the spurious casing collar detection event. This would be another example of using the second location estimate to correct the first location estimate. As a result, the first location estimate is corrected to 240 at the tenth string location 781*m*, and remains accurate for the remainder of the string locations 781*n* and 781*p* in comparison to the absolute location.

The discussion of FIG. 6 provides an example of how the first location estimate may be used to correct the second location estimate and vice versa. Note that if the first location estimate has been corroborated by reference to the second location estimate, the first location estimate may be used to recalibrate the second location estimate at each casing collar, thus limiting the error that accumulates in the second location estimate.

Figure 7:
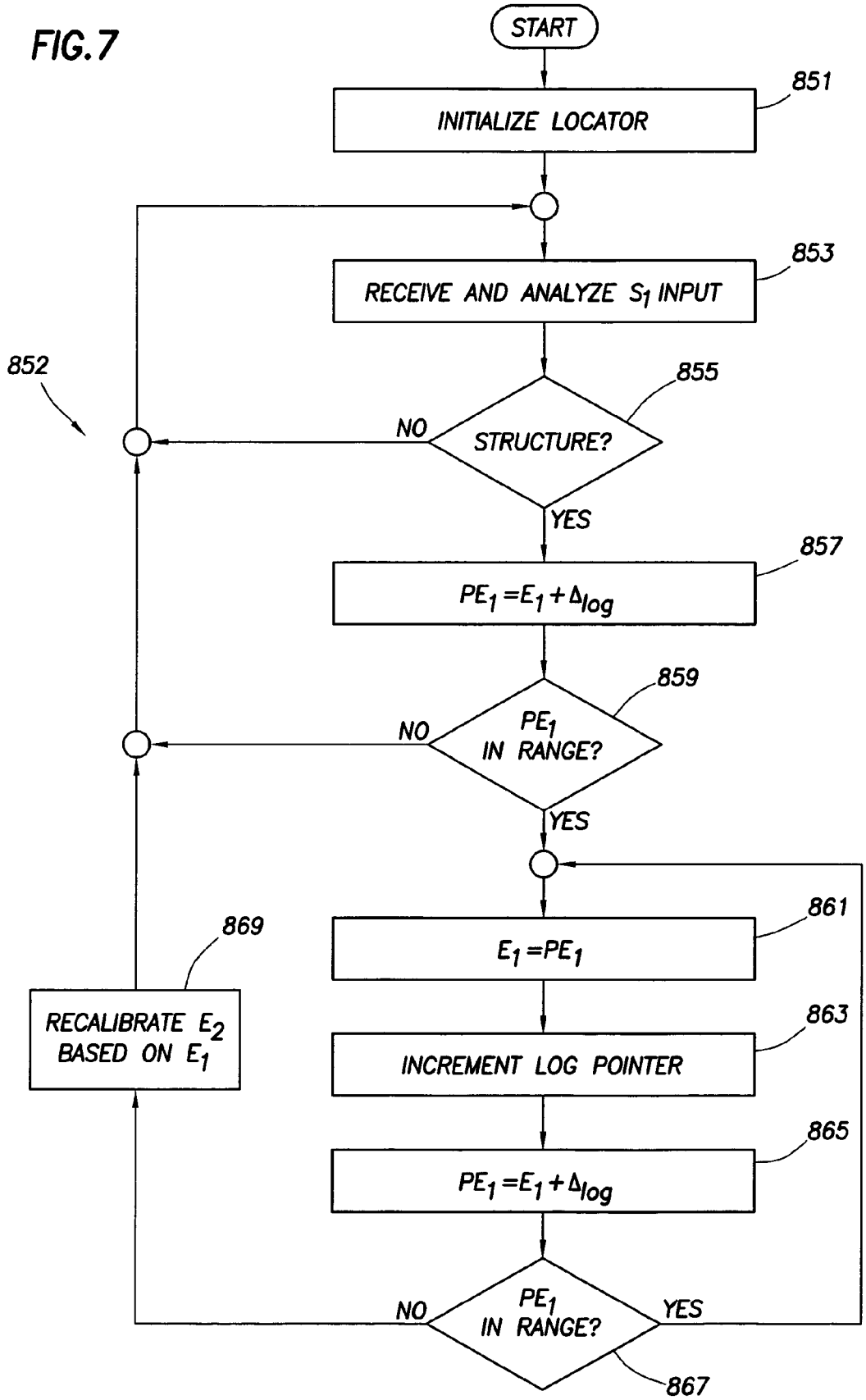
FIG. 7 is a flow chart for performing a method of self-location.

Turning now to FIG. 7, a flow chart depicts an embodiment of a method for corroborating a first location estimate and recalibrating a second location estimate, which may be referred to as data or sensor fusion. Such a method may be implemented via the locator component 761, for example in software, firmware, or combinations thereof. The values of the first and second location estimates are represented by $E_1$ and $E_2$, respectively. The method begins at block 851 where the locator component 761 is initialized. Initialization includes downloading a reference standard (e.g., the well bore log 765) and the mission program 767 in the locator component 761, for example, in a random access memory area accessible to the locator component 761. The well bore log 765 and the mission program 767 may be downloaded to the locator component 761, for example from a computer in communication with the locator component 761 prior to deploying the tool 755 into the well bore 120.

The embodiment shown in FIG. 7 uses a structured-environment type sensor as the first sensor 757 and a well bore log 765 to identify the position of casing segments. Those skilled in the art may readily adapt this exemplary method description to alternate embodiments, also contemplated by this disclosure, which may employ other structured-environment type sensors as the first sensor 757. Initialization also includes initializing a log pointer to reference the log information in the well bore log 765 associated with the first casing segment. As the following method proceeds, the log pointer will successively be reassigned to reference the log information in the well bore log 765 associated with other casing segments in the casing pipe. It is understood that sometime after initialization, the tool 755 is deployed into the well bore 120, and the method of FIG. 7 enters a continuous loop 852.

The method proceeds to block 853 where the locator component 761 receives the input (e.g., a sensed parameter) from the first sensor 757, represented by $S_1$ in FIG. 7, and analyzes the input from the first sensor 757. The first sensor 757 provides a first sensed parameter relating to a structure in the well bore 120. For example, the first sensor 757 provides an indication of casing collars.

The method proceeds to block 855 where, if no structure is detected, the method returns to block 853. If a structure is detected, the method proceeds to block 857 where a preliminary first location estimate, represented by $PE_1$ in FIG. 7, is determined. The information associated with a segment of the casing pipe is read from the well bore log 765 using the log pointer as a reference to the information. The length of the segment of casing pipe between connections is represented by $\Delta_{log}$ in FIG. 7. The value of $\Delta_{log}$ may be different for each segment of casing pipe. The value of the preliminary first location estimate, represented by $PE_1$, is assigned the value of the sum of the first location estimate plus the length of the segment of casing pipe. This is represented as $PE_1=E_1+\Delta_{log}$. $PE_1$ is said to be the preliminary first location estimate and is distinguished from $E_1$ the first location estimate, because the indication of a casing collar from the first sensor 757 may be spurious.

The method proceeds to block 859 where the preliminary first location estimate $PE_1$ is evaluated to determine if it is within a reasonable range of values for the location of the tool 755. The preliminary first location estimate $PE_1$ is compared to the second location estimate, $E_2$. If $PE_1$ is greater than E2 (which may be a cumulative location) and a maximum error attributable thereto, then $PE_1$ is deemed out of range and the method returns to block 853, without modifying the value of the first location estimate $E_1$. In this case, indication of a casing collar from the first sensor 757 is judged to be spurious and is ignored.

If $PE_1$ is not greater than $E_2$ and a maximum error attributable thereto, then $PE_1$ is deemed in range and the method proceeds to block 861 where the first location estimate $E_1$ is assigned the value of the preliminary first location estimate $PE_1$. In this case, the indication of a casing collar from the first sensor 757 is judged to be valid and the estimated location updated accordingly.

The method proceeds to block 863 where the log pointer is incremented to reference the information associated with the subsequent casing segment in the well bore log 765. The next time the locator component 761 accesses the well bore log 765, as at block 865, the information associated with a different casing segment will be accessed from the well bore log 765.

The method proceeds to block 865 where the preliminary first location estimate is redetermined following the same logic employed in block 857. The method proceeds to block 867 where the preliminary first location estimate is evaluated according to the logic employed in block 859. If $PE_1$ is deemed out of range, the method proceeds to block 869.

If $PE_1$ is deemed in range, the method returns to block 861 where the first location estimate $E_1$ is again assigned the value of the preliminary first location estimate. In this case $E_1$ has been incremented twice. This may be the case if the first sensor 757 overlooked a casing collar when the tool 755 passed the casing collar. The method continues to loop through blocks 861, 863, 865, and 867 until the preliminary first location estimate is deemed out of range; whereafter the method proceeds to block 869. The looping through blocks 861, 863, 865, and 867 accommodates the case when the first sensor 757 misses one or more casing collars. When the method proceeds to block 869 the first location estimate may be said to have been corroborated by the second location estimate.

At block 869 the second location estimate is recalibrated based on the corroborated value of the first location estimate, after which the method returns to block 853. In an embodiment, the second location estimate, $E_2$, is a linear function of the sensed parameter provided by the second sensor 759. This may be the case, for example, if the second sensor 759 provides an indication of hydrostatic pressure, cumulative distance, or time in the well bore 120. Then $E_2$ may be determined as $E_2=aP+b$, wherein P represents the well bore indication, and a and b are constants. When the method enters block 869, the first location estimate is presumed to be accurate, hence the equation $E_1=E_2=aP+b$ can be solved to recalibrate the constant value b to fit the equation to the known location given by $E_1$. This may be considered a first level of recalibration. A second level of recalibration may redetermine both constants a and b. This may be accomplished by storing the value of $E_1$ and the well bore indication P provided by the second sensor 759 from the previous (i.e., old) structure detection event and solving a system of equations such as the following for a and b using well known methods of linear algebra:

$$E_{1,old}=aP_{old}+b$$

$$E_{1,new}=aP_{new}+b$$

Alternative types of sensors may be used that sense one or more parameters that are acceptably approximated as a linear function of displacement into the well bore 120 over a distance of several casing segments. Alternately, similar function fitting may be performed for non-linear sensor indications using methods well known to the mathematical art.

Other recalibration techniques may employ Markov Decision Process, Kalman filter, neural network filter technologies, or combinations thereof, all of which are contemplated by the present disclosure. Further, these techniques may be used as the basis for the estimation of location. Instead of requiring either sensor measurement to be the accurate estimate of location, the sensor measurements may be combined into an estimation process to provide the location. For example, in a Kalman estimator the first parameter, the second parameter, the time rate of change of the first parameter, and the time rate of change of the second parameter may be input into the estimator. A Kalman estimator is typically a state-space representation that includes the dynamics of the system. In some embodiments, the output from the Kalman estimator may provide a preferred estimate for the location. If the error of the measurements can be cast as a structured uncertainty rather than as a random uncertainty, the weighting used to create the Kalman estimator can be weighted to minimize the effects of the structured uncertainty. In some embodiments, a Kalman estimator is preferred, such as where neither of the sensors 757, 759 is a structured-environment type sensor.

Recalibration may be particularly useful if the second sensor 759 is a hydrostatic pressure sensor, since the hydrostatic pressure in the well bore 120 varies linearly with displacement along the well bore 120 only if the fluid density is uniform throughout the entire well bore 120, which may not be the case. Other sensors may also depend upon an assumed uniform well bore characteristic which may not in fact be uniform, and hence these other sensors may particularly benefit from recalibration also.

A supplementary corroboration may be provided by identifying a short segment of casing in a sequence of long segments of casing. For example, if the $50^{th}$ casing segment is 30.12 foot long and the five casing segments on either side of the $50^{th}$ casing segment are all approximately 40 foot long, detecting this short casing segment can be used to corroborate the location of the tool 755.

The above method may be adopted for use with one or more additional primary (i.e., $E_1$) and secondary (i.e., $E_2$) sensors selected from the structural, absolute, relative, and cumulative sensor types. In an embodiment, $E_2$ is provided by a combination selected from absolute, relative, and cumulative sensors. In this case the corroborating indication $E_2$ may be selected from among several sensed parameters provided by the combination based on a determination of which of these sensors is providing the most accurate location indication at that time. When the first location estimate is updated, hence when the first location estimate is corroborated, each of the sensors in the combination may then be recalibrated against the known location provided by the corroborated first location estimate.

In an embodiment where the first sensor 757 and the second sensor 759 are identical sensors that are arrayed axially about the tool 755, the difference in time readings between the first sensor 757 and the second sensor 759 may be correlated to the downward velocity of the tool 755, as mentioned above. Additionally, the downward velocity of the tool 755 may be determined from successive structured-environment detections, for example casing collar detections, by dividing the distance between the structured-environment detections indicated in the well bore log 765 by the time it takes to traverse this distance. The locator component 761 may determine the first location estimate based on the parameters sensed by the first sensor 757 and the second sensor 759. The downward velocity of the tool 755, represented as V, may be employed by the locator component 761 to determine the second location estimate, as by determining a displacement $\Delta D$ during a short interval of time dt as $\Delta D=V\cdot dt$ and by determining the second location estimate $E_2$ as the sum of these displacements: $E_2=\Sigma(\Delta D)=\Sigma(V\cdot dt)$. Since velocity may not be constant, this equation may be modified to $E_2=\Sigma(\Delta D_i)=\Sigma(V_i\cdot dt)$, the sum of displacements of the tool 755 along the well bore 120 determined over relatively short intervals of time, using updated values of velocity $V_i$ determined using successive values of the first location estimate, reducing the error of the second location estimate. The second location estimate may be employed to reduce the error of the first location estimate, similarly to the processes described above. In the case where the first sensor 757 and the second sensor 759 are both CCL sensors, the second location estimate may be employed to corroborate the detection of casing collars as described above.

The above method is directed to corroborating a first location estimate and recalibrating a second location estimate. In an embodiment, the locator component 761 may at all times employ the second location estimate $E_2$ as the preferred estimate of the location of the tool 755 within the well bore.

Although the discussion of data or sensor fusion above is directed to an application in the autonomous downhole tool 755, those skilled in the art will readily appreciate that data or sensor fusion also may be used to advantage with traditional downhole tools. For example, logging tools are often used in positioning downhole tools in the wellbore 120, wherein the logging tool sends an indication of location to the surface. The accuracy of the logging tool may be improved, according to the present disclosure, by using the technique of data or sensor fusion to determine location or simply to improve the accuracy of the logging tool. For example, the logging tool may contain the first sensor 757, the second sensor 759, and the locator component 761. The locator component 761 may be modified to couple to a communication module within the logging tool whereby the locator component 761 provides the indication of location to the communication module, and the communication module transmits the indication of location to the surface 105 using well known communication mechanisms. Alternatively, the locator component 761 is operably connected to the sensors 757, 759 and may be positioned at the surface 105 or within the logging tool. Such a locator component 761 may communicate with the tool 755 via wireless communications (e.g. electronic signals, acoustic signals, or pressure pulses generated in a fluid flowing into the well bore 120); via a non-supportive communication line, or via other known communications means. Examples of non-supportive communication lines include microtubing, microwire, microfiber, fiber optics, and the like. Thus, the present disclosure contemplates the use of data or sensor fusion in traditional tools, including but not limited to tools that self-motivate or are self-propelled (e.g., robotic tools), tools that are conveyed through the well bore via traditional conveyance means, tools that send and receive location communications, tools that are not self-activating, and the like.

Figure 8:
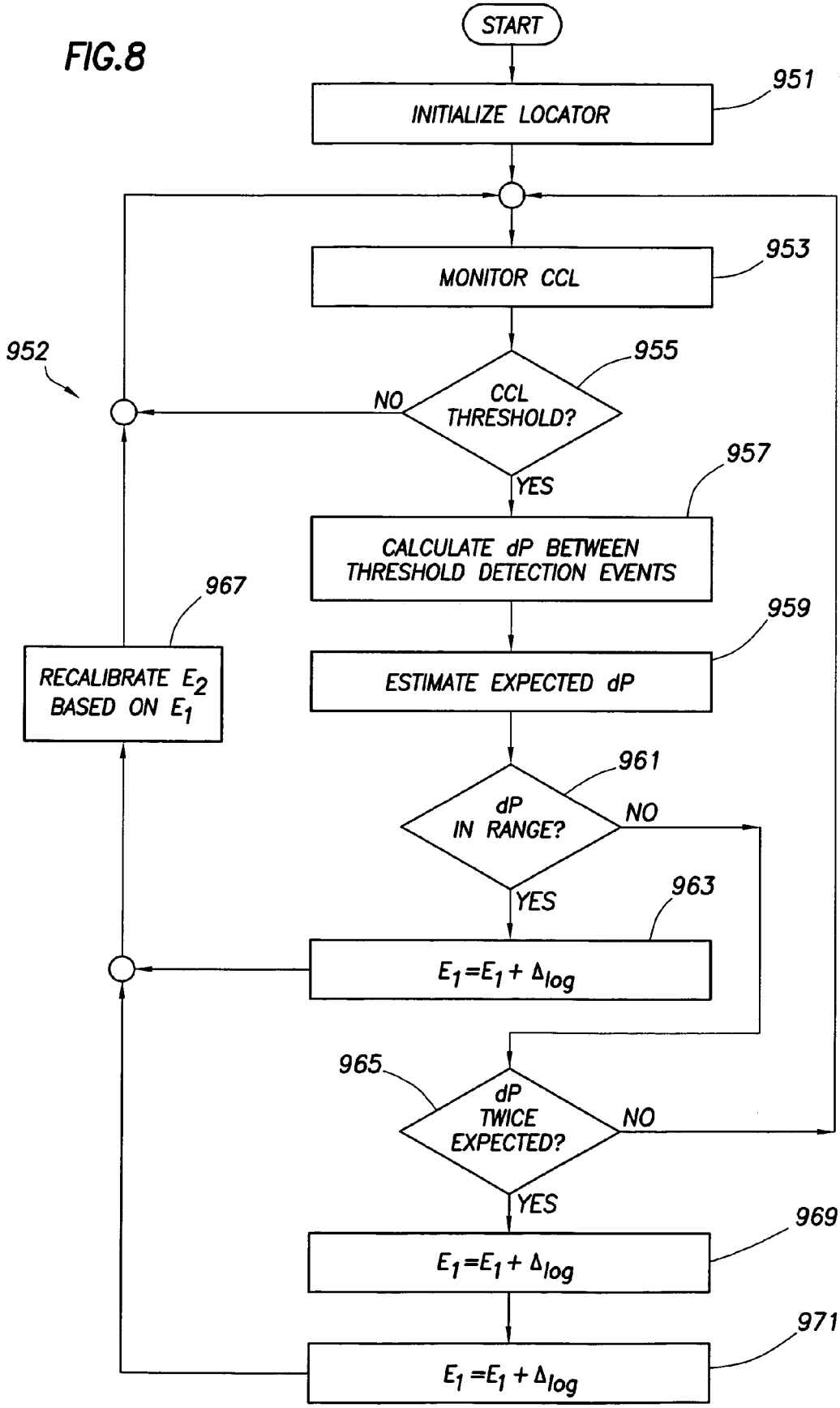
FIG. 8 is a flow chart for performing another method of self-location.

Turning now to FIG. 8, a flow chart depicts another embodiment of a method for corroborating the first location estimate and recalibrating the second location estimate. In this embodiment, the first sensor 757 is a CCL sensor providing a gross measurement, and the second sensor 759 is a hydrostatic pressure sensor providing a fine measurement. The method begins at block 951 where the locator component 761 is initialized. Initialization includes downloading the well bore log 765 and the mission program 767 in the locator component 761, for example in a random access memory area accessible to the locator component 761. The well bore log 765 and the mission program 767 may be downloaded to the locator component 761 from a computer in communication with the locator component 761 prior to deploying the tool 755 into the well bore 120. The well bore log 765 may identify the lengths of casing segments as well as other pertinent details of the casing string. Initialization includes initializing a log pointer to reference the log information in the well bore log 765 associated with the first segment of casing pipe. As the following method proceeds, the log pointer will successively be reassigned to reference the log information in the well bore log 765 associated with other segments of casing pipe. It is understood that sometime after initialization, the tool 755 is deployed into the well bore 120, and a continuous loop 952 is entered.

The method proceeds to block 953 where the locator component 761 monitors the output of the CCL. The method proceeds to block 955. If the output from the first sensor 757 does not exceed a threshold, then the method returns to block 953. If the output from the first sensor 757 exceeds the threshold, which may be termed a "threshold event", the method proceeds to block 957 where a pressure differential is determined, represented by dP in FIG. 8. The threshold event is considered uncorroborated until later. The sensed pressure differential dP is determined from the current indication of hydrostatic pressure output by the second sensor 759 and the indication of hydrostatic pressure output by the second sensor 759 when the last corroborated threshold event occurred.

The method proceeds to block 959 where the locator component 761 reads the information in the well bore log 765 referenced by the log pointer, determines the length of the casing segment according to the information read from the well bore log 765, and determines an expected pressure difference across such length.

The method proceeds to block 961 where if the sensed pressure difference is close to the expected pressure difference then the method proceeds to block 963, otherwise the method proceeds to block 965. In block 963 the first location estimate is updated by adding the increment of length indicated by the information in the well bore log 765 referenced by the log pointer to the existing value of the first location estimate. The log pointer is incremented to point to the next casing segment information in the well bore log 765. The method proceeds to block 967 where the second location estimate is recalibrated as discussed above.

In block 965 if the pressure difference is close to twice the expected pressure difference then the method proceeds to blocks 969 and 971, otherwise the method returns to block 953. In block 969 the first location estimate is updated a first increment by adding the increment of depth indicated by the information in the well bore log 765 referenced by the log pointer to the old value of the first location estimate. The log pointer is updated (e.g., incremented) to point to the next casing segment information in the well bore log 765. The method proceeds to block 971 where the first location estimate is updated a second increment by adding the increment of length indicated by the information in the well bore log 765 referenced by the updated log pointer. The log pointer is updated again (e.g,. incremented a second time) to point to the next casing segment information in the well bore log 765. The method proceeds to block 967 where the second location estimate is recalibrated as discussed above. When the method proceeds to block 967 the first location estimate is considered to have been corroborated and the associated threshold event is also considered corroborated.

The mission program 767 provides commands or event-response pairs that the locator component 761 uses to trigger functions provided by the functional component 763, as described in more detail herein. The mission program 767 may comprise a computer program or software routine that the locator component 761 may invoke. Alternately, the mission program 767 may be a table, a file, or other structure containing data which associates a well bore location, for example a depth of 16,000 feet, with a function trigger, for example deploying a frac plug. The mission program 767 may be said to customize the generic functionality of the locator component 761 to provide specific functions for a specific well bore 120.

Referring again to FIG. 4, the autonomous downhole tool 755 may comprise one or more functional components 763 to perform any number of functions at one or more locations sensed by the autonomous downhole tool 755. By way of example only, the functional components 763 may be operable to perforate the well bore casing 125; evaluate the formation F; evaluate another downhole component 150, such as a well bore assembly, for example; isolate a segment of the well bore 120; release a detachable component 800 of the tool 755, or any combination thereof.

In an embodiment, one functional component 763 of the autonomous downhole tool 755 is a rotator operable to rotate the tool 755 to a desired azimuth orientation within the well bore 120. In an embodiment, the rotator comprises a mechanical interface on the bottom of the tool 755 operable to engage a mating element on the top of another downhole component 150, thereby rotating the tool 755 to a desired azimuth orientation with respect to the downhole component 150. In another embodiment, the rotator comprises a motor operable to rotate the tool 755 to a desired azimuth orientation. In an embodiment, the motor is activated based on data from an azimuth sensor, such as a gyro.

It may be desirable to control the descent of the tool 755 within the well bore 120, for example, so as to prevent damage to the tool 755 at diameter changes in the casing 125, so as to prevent high stresses on the tool 755 when it stops, or so that the tool 755 does not overshoot the target location. Thus, in an embodiment, one functional component 763 of the autonomous downhole tool 755 is a braking system 760 operable to dissipate the linear kinetic energy of the tool 755 as it traverses the well bore 120. The braking system 760 controls the descent of the tool 755 so as to slow the tool 755, stop the tool 755, or both. In an embodiment, the braking system 760 utilizes a velocity proportional technique to slow the tool 755 by applying a slowing force proportional to the velocity of the moving tool 755. Thus, an increase in the velocity of the tool 755 results in a corresponding increase in the slowing force, and vice versa. In an embodiment, the braking system 760 utilizes a constant technique to slow and/or stop the tool 755 by applying a slowing force that is independent of the velocity of the moving tool 755. Both the velocity proportional technique and the constant technique convert the linear kinetic energy of the moving tool 755 into another form of energy, such as thermal energy, rotary kinetic energy, or electrical energy, for example.

Various embodiments of braking systems 760 utilizing velocity proportional techniques may be provided. In more detail, in an embodiment, the braking system 760 comprises a fluid drag component, such as a parachute, for example, to cause drag on the descending autonomous downhole tool 755. A higher velocity of the tool 755 would create more drag, thereby providing a relatively constant rate of descent. The parachute could be rigid or flexible, and it could be located above or below the tool 755.

In another embodiment, the braking system 760 comprises flow-induced drag blocks that are forced against the casing 125 (or uncased wall of the well bore 120) in response to a pressure differential created between the upper and lower end of the tool 755 during descent. A higher velocity of the tool 755 would create more pressure differential, thereby exerting a higher force between the drag blocks and the casing 125 to slow the tool 755. Return springs may be incorporated into the drag blocks to cause them to retract when the tool 755 slows.

In an embodiment, the braking system 760 comprises magnets, such as sheet magnets, button magnets, electromagnets, or combinations thereof, for example, disposed towards the exterior of the tool 755. As the tool 755 descends, eddy currents are generated in the casing 125 to slow the velocity of the tool 755. In particular, by moving the magnets along the metal casing 125, a whirlpool of circulating charge, i.e. eddy currents, are generated that quickly decay into heat. Thus, the linear kinetic energy of the moving tool 755 is dissipated into heat via the eddy currents created by the magnets.

In an embodiment, the braking system 760 comprises a rotating wheel connected to a generator. The wheel engages and rotates against the casing 125 or well bore wall as the tool 755 descends to produce electrical energy in the generator. A higher velocity of the tool 755 leads to faster rotation of the wheel, thereby creating a larger drag on the generator to slow the descent of the tool 755.

In an embodiment, the braking system 760 comprises a feature of the tool 755 that causes the tool 755 to spin as it descends in the well bore 120. By way of example, a plurality of fins may be disposed on the exterior of the tool 755 to cause it to spin. By spinning the tool 755, the linear kinetic energy of the descending tool 755 is reduced as it is transferred to rotary kinetic energy.

Various embodiments of braking systems 760 utilizing constant techniques to slow and/or stop the tool 755 may also be provided. In more detail, in an embodiment, the braking system 760 comprises mechanical slips having teeth that bite into the casing 125. In an embodiment, the braking system 760 comprises drag blocks, namely mechanical slips without teeth. The drag blocks may be rigid blocks that follow the contour of the casing 125 or open wall of the well bore 120, thereby producing a drag force opposite the direction of travel. Alternatively, the drag blocks may have flexible fingers that provide a slowing force while the blocks provide a stopping force. Further, the drag blocks may comprise magnets to increase the friction for stopping the tool 755.

In another embodiment, the braking system 760 comprises a permanent magnet, an electromagnet, or a combined permanent/electromagnet to create a frictional braking force. A permanent magnet creates a constant attractive force between the tool 755, or a component thereof, and the casing 125; whereas an electromagnet is selectively operable to create an attractive force between the tool 755, or a component thereof, and the casing 125. The attractive force results in frictional drag with the casing 125, thereby slowing the autonomous downhole tool 755. Using a combined permanent/electromagnet, selective operation of the electromagnet may cancel the field generated by the permanent magnet. Thus, a combined permanent/electromagnet provides a releasable or controllable magnetic assembly for applying or releasing the braking system 760.

In another embodiment, the braking system 760 comprises an adhesive. In an embodiment, the adhesive is forced or injected into the annular gap between the tool 755 and the casing 125. Such adhesive may comprise a high viscosity that creates a frictional drag against the casing 125, thereby slowing the tool 755. Alternatively, such adhesive may comprise expansive properties to create pressure against the casing 125, thereby slowing the tool 755. As the tool 755 slows, the adhesive increasingly adheres to the casing 125, which eventually stops the tool 755. In another embodiment, the adhesive is injected internally of the tool 755 to close off a flowbore, for example, thereby preventing fluid flow through the tool 755, which slows and/or stops the tool 755. The adhesive may be thermosetting, such as an epoxy, or the adhesive may be thermoplastic. The adhesive may further comprise a cross-linking agent, and cross-linking may be accomplished by chemical, electrical, or magnetic stimulation, or a combination thereof.

In another embodiment, the braking system 760 comprises a suction force created by hydraulic pressure. In yet another embodiment, the braking system 760 comprises an inflatable chamber that contacts the casing 125 or the open well bore wall, similar to an inflatable packer, for example. Chemical out-gassing, compressed pressure release, or pumped fluid, for example, could be used to inflate the chamber to stop the tool 755.

Accordingly, in various embodiments, the braking system 760 comprises a fluid drag component, a pressure differential component, an eddy current component, a generator component, a rotary component, a mechanical component, a magnetic component, an adhesive component, a suction component, an inflatable component, a variable buoyancy component, or a combination thereof.

In an embodiment, the braking system 760 is operable to set the tool 755 against a casing 125, or set the tool 755 against an open hole wall in the well bore 120. In an embodiment, the braking system 760 is releasable to unset the tool 755 from the casing 125 or from the open hole wall of the well bore 120. In an embodiment, the releasable braking system 760 comprises a frangible component, such as a shear pin or a rupture disc, for example, that is fragmented to unset the tool 755.

In another embodiment, the releasable braking system 760 comprises a dissolvable material that is dissolved to unset the tool 755. The dissolvable material may comprise a composition that dissolves when exposed to a chemical solution, an ultraviolet light, or a nuclear source, such as an epoxy resin, a fiberglass, or a glass-reinforced epoxy resin, for example; a eutectic composition that melts and flows away when heated; a composition, such as an adhesive, for example, that degrades in a well bore environment; a biodegradable material that degrades in a well bore environment, or a combination thereof. Suitable biodegradable materials are disclosed in copending U.S. patent application Ser. No. 10/803,689 filed on Mar. 17, 2004, entitled "Biodegradable Downhole Tools", and copending U.S. patent application Ser. No. 10/803,668, filed on Mar. 17, 2004, entitled "One-Time Use Composite Tool Formed of Fibers and a Biodegradable Resin", which are both owned by the assignee hereof, and are both hereby incorporated by reference herein for all purposes. In an embodiment, the releasable braking system 760 comprises a mechanical braking component coupled to the tool 755 via a dissolvable material, such as an adhesive, for example. Thus, when the adhesive dissolves, the tool 755 is released from the mechanical braking component so that the tool 755 resumes traversing the well bore 120 while the mechanical braking component is left behind or falls to the bottom of the well bore 120.

In still another embodiment, the releasable braking system 760 may be selectively activated to slow or stop the tool 755, and selectively deactivated to release the braking system 760 so that the tool 755 resumes movement within the well bore 120. The braking system 760 may be deactivated, for example, by retracting a mechanical component or parachute; demagnetizing a magnetic component; deflating an inflatable component; removing suction for a suction component; reheating a thermoplastic adhesive component; or by applying a counter force to the braking force. In an embodiment, the releasable braking system 760 may be selectively reactivated at another location in the well bore 120. Thus, a selectively activated and deactivated braking system 760 is operable at a plurality of well bore locations to slow or stop the tool 755, then release the tool 755.

In an embodiment, the autonomous downhole tool 755 is self-activating. In particular, referring again to FIG. 4, in an embodiment, the autonomous downhole tool 755 comprises one or more activators 790 operable to activate the one or more functional components 763 of the tool 755, including the braking system 760, at one or more locations in the well bore 120. In an embodiment, the one or more locations are sensed by the navigation system 756.

In an embodiment, the activator 790 comprises a source of energy stored on the tool 755, and a trigger for releasing the stored energy to activate one or more of the functional components 763. The stored energy source may comprise mechanical, chemical, electrical, or hydraulic energy, for example. In an embodiment, the trigger comprises an electrically driven part, such as a pilot valve or clutch. In an embodiment, the trigger comprises a spark to start a chemical reaction or cause an explosion. In various embodiments, the trigger of the one or more activators 790 releases the stored energy in response to communications from the navigation system 756; in response to communications from the surface 105, such as via the cable 118, via a non-supportive communication line, or via wireless communications (e.g. electronic signals, acoustic signals, or pressure pulses generated in a fluid flowing into the well bore 120); in response to communications from another downhole component 150; or a combination thereof.

Thus, the one or more activators 790 may activate the one or more functional components 763 of the tool 755 via a mechanical operation, a chemical operation, an electrical operation, a hydraulic operation, an explosive operation, a timer-controlled operation, or any combination thereof.

By way of example only, in an embodiment, the trigger of the activator 790 comprises an elastic spring that expands or a shear pin that shears to release mechanical or hydraulic stored energy for activating one or more functional components 763 of the tool 755.

In an embodiment, the trigger of the activator 790 starts a chemical reaction that generates heat to activate one or more functional components 763 by setting a phase change material, for example, such as a shape memory alloy or a eutectic material. In another embodiment, the trigger of the activator 790 starts a chemical reaction that generates pressure to hydraulically activate one or more functional components 763 of the tool 755. In yet another embodiment, the trigger of the activator 790 starts a chemical reaction that generates electricity for activating one or more functional components 763. In still another embodiment, the trigger of the activator 790 starts a chemical reaction that generates a gas to activate one or more functional components 763, such as to drive a piston, for example.

In other embodiments, the trigger of the activator 790 may engage a battery or a capacitor to drive a motor or a lead screw, for example, to gain mechanical advantage. In still other embodiments, the trigger of the activator 790 may comprise a rupture disc that ruptures or a pilot valve that opens to release hydraulic energy to activate one or more functional components 763. In further embodiments, the trigger of the activator 790 may comprise an igniter to activate a detonator that generates an impact load or a shock load, for example. As one of ordinary skill in the art will appreciate, any combination of the various embodiments of the activators 790 herein described, as well as other types of activators, may be employed to activate one or more functional components 763 of the tool 755.

In an embodiment, the autonomous downhole tool 755 comprises one or more detachable components 800 operable to selectively detach from the tool 755 within the well bore 120. In an embodiment, the detachable component 800 is returnable to the surface 105 after detaching from the tool 755. In various embodiments, the detachable component 800 may be buoyant and ascend in the well bore 120 to the surface 105 via buoyancy; or may be flowable and ascend in the well bore 120 to the surface 105 via circulation of a flowing fluid, or may be retrieved via a connection to the surface 105, such as via cable 118, or a combination thereof.

In an embodiment, the detachable component 800 comprises a functional component 763 or combinations thereof. In an embodiment, the detachable component 800 comprises an enclosure for holding a fluid sample, a core sample, or a consumable component of the autonomous downhole tool 755, for example. In an embodiment, the detachable component 800 comprises the navigation system 756 or a portion thereof, such as a memory component, for example. Thus, at least a portion of the navigation system 756 may be returned to the surface 105 and reused. In an embodiment, the detachable component 800 comprises a logging device 850 that is independent of the navigation system 756. In an embodiment, the logging device 850 is operable to sense and record parameters as the device descends with the tool 755 in the well bore 120.

In another embodiment, the logging device 850 may be provided as a separate component from the autonomous downhole tool 755. In an embodiment, the separate logging device 850 is untethered to the surface 105 and is operable to sense and record parameters as the device descends and ascends in the well bore 120. In an embodiment, the separate logging device 850 does not communicate with the surface 105 as it traverses in the well bore 120. In an embodiment, the separate logging device 850 is sufficiently small so as not to create operational concerns or safety hazards should the device 850 fail to return to the surface 105. In an embodiment, the separate logging device 850 is a miniature logging device. In various embodiments, the separate logging device 850 is less than approximately 1-inch in diameter, less than approximately ¾-inch in diameter, less than approximately ½-inch in diameter, or less than approximately ¼-inch in diameter. In an embodiment, the separate logging device 850 comprises a navigation system 756.

In various embodiments, the separate logging device 850 descends in the well bore 120 via a cable 118, fluid circulation, gravity, or a combination thereof. In various embodiments, the separate logging device 850 ascends in the well bore 120 via a cable 118, fluid circulation, buoyancy, or both. In an embodiment, the separate logging device 850 comprises a variable buoyancy body, wherein buoyancy may be changed by releasing a mass, releasing a positively buoyant component from a negatively buoyant component, emptying a ballast tank, releasing a gas bubble, or inflating a balloon, for example. In various embodiments, the descent and ascent of the separate logging device 850 is controlled by time, location, memory usage, or a combination thereof. The separate logging device 850 may be used to verify that an autonomous downhole tool 755 is set against the casing 125 in the proper location within the well bore 120, for example.

Referring again to FIG. 4, in an embodiment, the autonomous downhole tool 755 further comprises a spacing component 900. In FIG. 4, the spacing component 900 is shown coupled to the bottom thereof for spacing the tool 755 a distance from a location in the well bore 120, such as a plug set at the location, the bottom of the well bore 120, or a change in internal diameter of the well bore 120 at the location, for example. One exemplary autonomous downhole tool 755 may comprise a perforating gun with a spacing component 900 coupled to the bottom thereof for positioning the gun at a distance from a frac plug set in the well bore 120. In an embodiment, the frac plug may also be an autonomous downhole tool 755.

In an embodiment, the spacing component 900 may be coupled to the top rather than the bottom of the tool 755. Thus, the spacing component 900 may position the tool 755 with either a compressive load or a tensile load. The spacing component 900 may also act to control the descent of a tool 755 that is free-falling via gravity into the well bore 120. For example, the spacing component 900 may comprise fins that cause the tool 755 to spin as it moves within the well bore 120.

In another embodiment, the spacing component 900 is provided as a separate component from the tool 755 and is releasable into the well bore 120. In particular, the releasable spacing component 900 is disposed within the well bore 120 by being dropped, pumped, released from a wireline, released from a coiled tubing, released from a slick line, released from jointed pipe, or a combination thereof. In an embodiment, the releasable spacing component 900 is an autonomous downhole tool 755.

In an embodiment, the spacing component 900 has an adjustable length comprising at least a first length that positions the autonomous downhole tool 755 at a distance from the location within the well bore 120, and at least a second length that positions the tool 755 at approximately the location. In various embodiments, the spacing component 900 is collapsible, foldable, bendable, buckleable, or a combination thereof. Thus, the spacing component 900 may be extended when the tool 755 is positioned at a distance from the location, and the spacing component 900 may be at least partially collapsed, folded, bent, buckled or a combination thereof, when the tool 755 is positioned approximately at the location. In an embodiment, the spacing component 900 is extendable from a non-extended position, locks or sets in the extended position to provide the desired spacing function, and subsequently unlocks or unsets to return to the non-extended position.

In an embodiment, the length of the spacing component 900 is extendable and/or adjustable, for example via fluid flow through the spacing component 900. In an embodiment, such a spacing component 900 comprises a telescoping body having an inner member and an outer member, wherein at least one of the members is moveable axially with respect to the other member in response to fluid flow through the telescoping body. In an embodiment, the length of the spacing component 900 is adjustable proportionately to the flow rate of the fluid flowing through the telescoping body.

In other embodiments, the spacing component 900 is frangible, dissolvable, degradable, combustible, or a combination thereof. In various embodiments, the spacing component 900 comprises magnesium, cast iron, a ceramic, a composite material, or a combination thereof. Thus, the spacing component 900 may be intact when the tool 755 is positioned at a distance from the location, and the spacing component 900 may be at least partially fragmented, dissolved, burned away, or a combination thereof when the tool 755 is positioned approximately at the location. By way of example only, a ceramic or brittle cast iron spacing component 900 may be fragmented using a detonation cord or a shock wave, such as when a perforating gun is fired, for example; a magnesium spacing component 900 may be chemically dissolved by an acid; a composite spacing component 900 may be chemically dissolved by certain caustic fluids; and a combustible spacing component 900 could be burned away via a low-order detonation.

Further, a spacing component 900 comprising a flexible material may buckle under a shock load or impact load imparted when a perforating gun is fired, for example. In an embodiment, the spacing component 900 comprises a segmented linkage, such as a compound scissor mechanism, for example, that folds upon itself. In an embodiment, the spacing component 900 comprises concentric tubes with fragible shear pins that enable the tubes to collapse from a fully-extended position.

In an embodiment, the spacing component 900 further comprises an activation mechanism 950 that activates to adjust its length, for example lengthening or shortening the spacer component 900. In various embodiments, the activation mechanism 950 comprises a detonator, a chemical solution, a shear pin, a shock load, an impact load, or a combination thereof. The activation mechanism 950 may be operable via a mechanical operation, a chemical operation, an explosive operation, an electrical operation, a timer-controlled operation, a hydraulic operation, or a combination thereof. In an embodiment, the activation mechanism 950 is triggered by the navigation system 756, such as, for example, to extend the length of the spacing component 900 as it approaches a target location within the well bore 120 and/or when the autonomous downhole tool 755 is being slowed by the braking system 760. In an embodiment, the activation mechanism 950 is triggered in response to or in coordination with the operation of one or more tools located proximate the spacing component 900, for example upon firing of a perforating gun spaced a distance by the spacing component 900.

Figure 9:
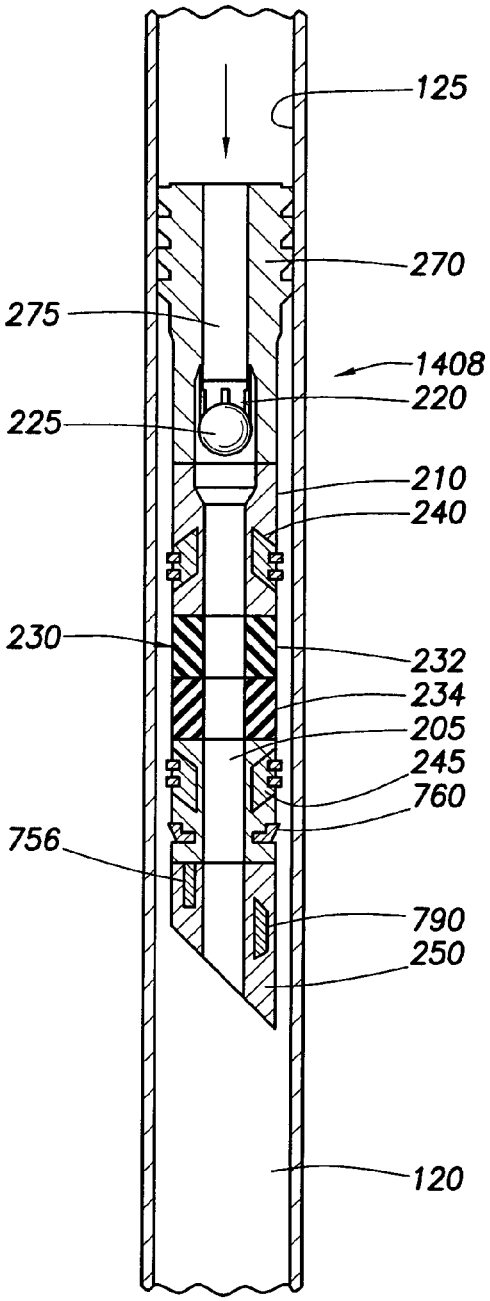
FIG. 9 is an enlarged cross-sectional side view of an embodiment of an autonomous downhole tool comprising a frac plug in a run-in position.
Figure 10:
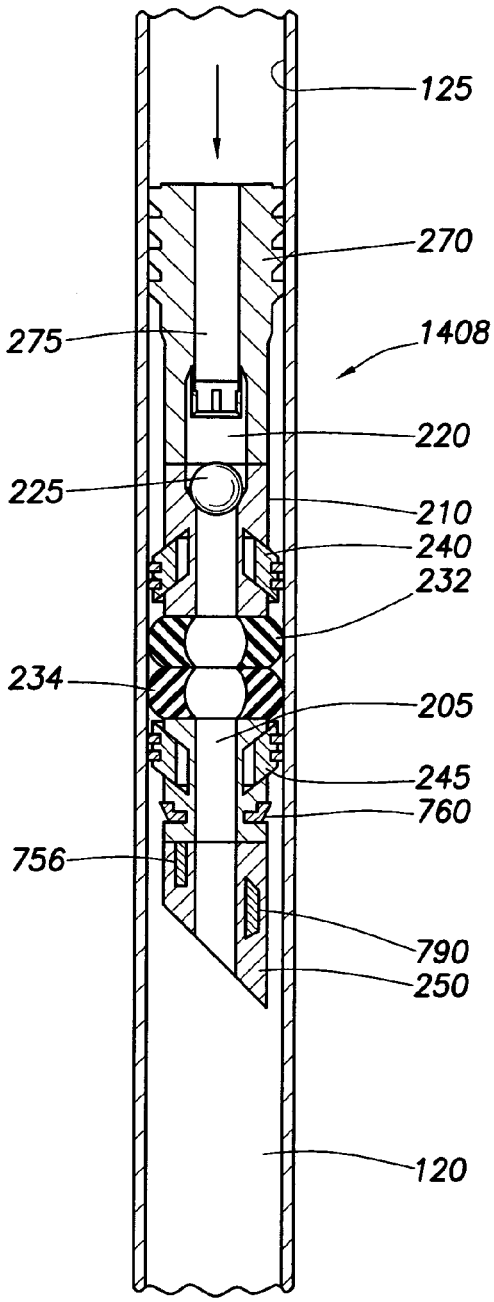
FIG. 10 is an enlarged cross-sectional side view of the autonomous frac plug of FIG. 9 in a set position wherein fluid is prevented from flowing downwardly through the frac plug.
Figure 11:
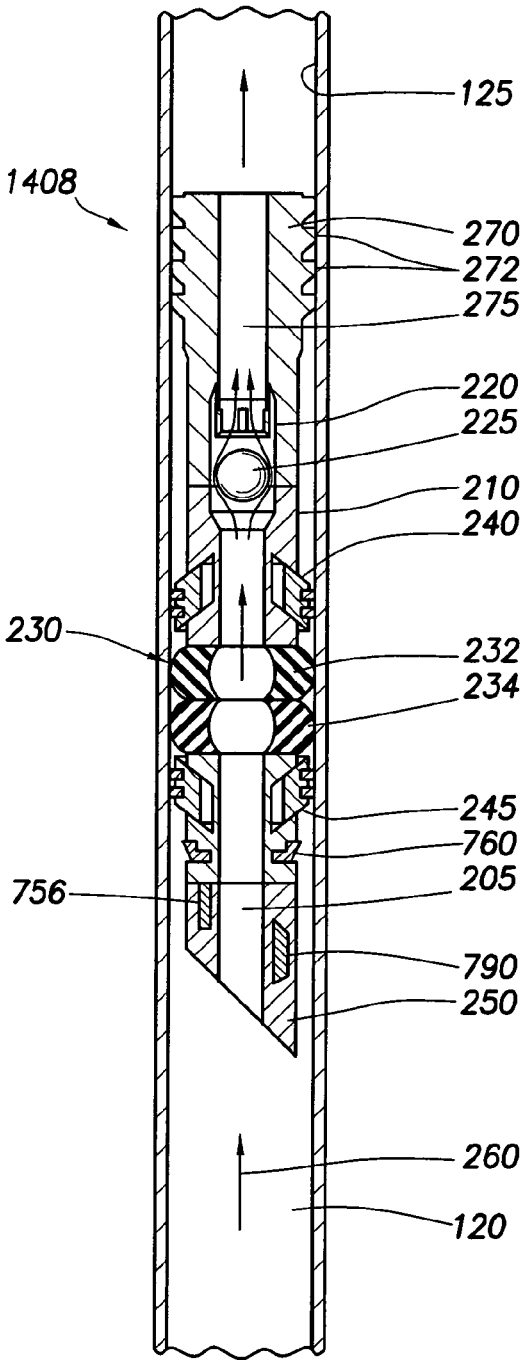
FIG. 11 is an enlarged cross-sectional side view of the autonomous frac plug of FIG. 9 in the set position wherein fluid is permitted to flow upwardly through the frac plug.
Figure 12:
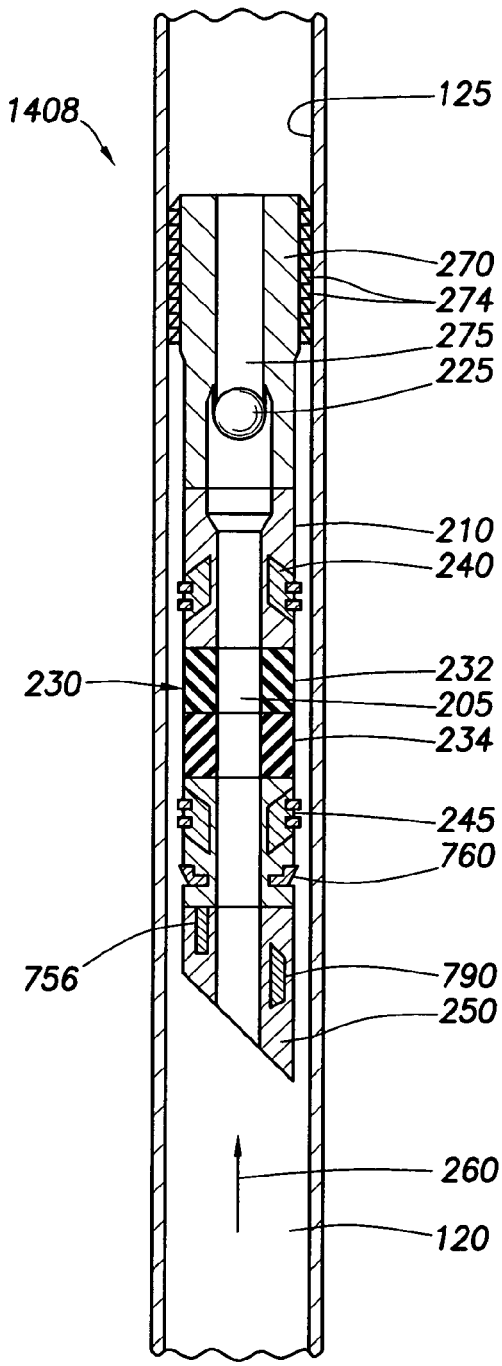
FIG. 12 is an enlarged cross-sectional side view of the autonomous frac plug of FIG. 9 in a flow-back position to return the autonomous frac plug to the surface.

The autonomous downhole tool 755 may take a variety of different forms. In an embodiment, the tool 755 comprises a plug that is used in a well stimulation/fracturing operation, commonly known as a "frac plug." FIG. 9 depicts an exemplary autonomous frac plug 1408 in a run-in position as the frac plug 1408 is being pumped into the well bore 120 from the surface 105 or descends within the well bore 120 via gravity, FIG. 10 depicts the frac plug 1408 in a set position against casing 125 in the well bore 120 wherein servicing fluid is prevented from flowing downwardly through the frac plug 1408, FIG. 11 depicts the frac plug 1408 in the set position wherein production fluid is permitted to flow upwardly through the frac plug, and FIG. 12 depicts the frac plug 1408 in a flow-back position for returning the frac plug 1408 to the surface 105 after the well stimulation/fracturing operation is complete.

The frac plug 1408 comprises an elongated tubular body member 210 with an axial flowbore 205 extending therethrough. An optional wiper plug 270 is disposed at the upper end of the body member 210. The wiper plug 270 comprises at least one set of wiper blades 272 that act to form a sealing engagement with the casing 125 so that the plug 1408 may be pumped into the well bore 120. The wiper plug 270 has an axial flowbore 275 extending therethrough that is in fluid communication with the axial flowbore 205 through the body member 210.

A cage 220 is housed within the wiper plug 270 for retaining a ball 225 that operates as a one-way check valve. In particular, when the frac plug 1408 is set, the ball 225 seals off the flowbore 205 to prevent servicing fluid from flowing downwardly through the frac plug 1408, as depicted in FIG. 10, but the ball 225 allows production fluid to flow upwardly through the flowbore 205, as shown in FIG. 11.

A packer element assembly 230, which comprises at least an upper sealing element 232 and a lower sealing element 234, extends around the body member 210. An upper set of slips 240 and a lower set of slips 245 are mounted around the body member 210 above and below the packer assembly 230, respectively. In an embodiment, a braking system 760 is disposed around the body member 210, below the lower set of slips 245.

A tapered shoe 250 is provided at the lower end of the body member 210 for guiding and protecting the frac plug 1408 as it traverses the well bore 120. In an embodiment, the navigation system 756 of the autonomous frac plug 1408 is disposed in the tapered shoe 250 below the body member 210. In an embodiment, the navigation system 756 is detachable and returnable to the surface 105. As previously described, the navigation system 756 may be initialized at the surface 105 before the plug 1408 is deployed into the well bore 120. Initialization may include providing the navigation system 756 with a well bore log and a mission program that identifies the one or more locations in the well bore 120 to set the frac plug 1408. In an embodiment, an activator 790 for activating the braking system 760 is also disposed in the tapered shoe 250. In an embodiment, the activator 790 comprises a small explosive charge that when detonated, opens a chamber to external hydrostatic forces that activate the braking system 760.

Referring now to FIG. 10, to set the frac plug 1408 as shown, the navigation system 756 determines the target location within the well bore 120, as previously described, and the activator 790 activates the braking system 760 as the frac plug 1408 approaches the location. The braking system 760 sets the lower slips 245 of the plug 1408 against the casing 125. Then hydraulic fluid forces from above the frac plug 1408 act against the wiper plug 270 since flow is prevented through the flow bore 205 of the frac plug 1408 by the ball 225. These hydraulic forces act to compress the packer assembly 230 downwardly against the lower slips 245 and outwardly against the casing 125, thereby sealing off the well bore 120 below the frac plug 1408. Once the packer assembly 230 is fully compressed, the upper slips 240 engage the casing 125, thereby retaining the packer 230 in the set position.

Referring now to FIG. 11, after the frac plug 1408 has been set to isolate a zone of the well bore 120 below the frac plug 1408, production fluids from the isolated zone may flow upwardly through the frac plug 1408, thereby unseating the ball 225 from the flowbore 205 to permit the production fluids to flow up the well bore 120 for recovery at the surface 105, such as at the well head.

After the well stimulating/fracturing operation is complete, the frac plug 1408 may be removed from the well bore 120. In an embodiment, to remove the frac plug 1408 from the set position of FIG. 10, the braking system 760 releases, as previously described herein, to unset the lower slips 245 from the casing 125. In an embodiment, the frac plug 1408 is then returnable to the surface 105. In particular, referring now to FIG. 12, in an embodiment, at least a portion of the cage 220 is selectively removable such that once the lower slips 245 are unset, hydraulic fluid forces flowing upwardly from the producing zone of the formation F below the frac plug 1408, as represented by the flow arrow 260, act to move the ball 225 upwardly, thereby sealing the flowbore 275 of the wiper plug 270. In this position, the ball 225 prevents flow upwardly through the flow bore 205 of the frac plug 1408. Further, in an embodiment, the wiper plug 270 may be configured with selectively reversible wiper blades 272 that can be flipped 180-degrees top-to-bottom so as to provide wiper blades 274 that are oriented in the opposite direction, as shown in FIG. 12. Alternatively, the wiper plug 270 may be configured with two sets of selectively retractable/extendable wiper blades 272, 274 that are oriented in opposite directions from one another such that the wiper blades 272 for moving the frac plug 1408 downwardly within the well bore 120 may be retracted, and the wiper blades 274 for moving the frac plug 1408 upwardly within the well bore 120 may be extended. Therefore, the upward force of the fluid 260 acting against the wiper plug 270 causes the upper slips 245 to disengage from the casing 125 and the packer assembly 230 to decompress, thereby unsealing the well bore 120. Then the frac plug 1408 flows upwardly to the surface 105 in the flow-back position depicted in FIG. 12.

In embodiments, a well bore zonal isolation device, such as the frac plug 1408 described herein, or a perforating gun, is movable along at least a partial length of the well bore 120 via an external force and has a communication line connected from the device 1408 to the surface 105. In an embodiment, the communication line is non-supportive of the device 1408 in the well bore 120, in contrast to the cable 118, which has the ability to support the entire device 1408 as it is conveyed into or retrieved from the well bore 120. The communication line is operable to provide communications to and from the device 1408 located in the well bore 120, for example electronic or hydraulic communications. Examples of communication lines include microtubing, microwire, microfiber, fiber optics, and the like, and a source of such communication line may be located at the surface 105 and fed out as the device 1408 traverses the well bore 120 or vice-versa.

In an embodiment, the device 1408 is pumped and/or free-falls via gravity in the well bore 120, and the communication line is sized such that it does not interfere with the pumping and/or free fall. In an embodiment, the device 1408 comprises a navigation system 756 as disclosed herein, for example a navigation system 756 comprising at least two sensors 757, 759 located on the device 1408. The sensors 757, 759 communicate with a locator component 761 to determine the location of the device 1408, wherein the locator component 761 may be located onboard the device 1408 or at the surface 105 and communicating with the device via the communication line.

In an embodiment, the device 1408 is operable in response to the navigation system 756. For example, the zonal isolation device 1408 sets/releases or the perforating gun fires in response to the navigation system 756. In an embodiment, the device 1408 comprises a braking system 760 as disclosed herein, which may be responsive to the navigation system 756. In an embodiment, the device 1408 comprises a spacing component 900 as disclosed herein, which may be responsive to the navigation system 756. Alternatively, the spacing component 900 may be operable in response to braking, for example extending via inertial force.

In operation, the various embodiments of the autonomous downhole tools 755 described herein may be employed to perform a variety of different well servicing methods. In an embodiment, the autonomous downhole tool 755 is deployed at least a partial length into the well bore 120 via an external force, as described herein. In an embodiment, the autonomous downhole tool 755 self-determines its location as it traverses the well bore 120, as described herein, without receiving location communications from an external source. In an embodiment, the autonomous downhole tool 755 brakes to self-slow and/or self-stop the tool 755, as described herein, at one or more sensed locations in the well bore 120. In an embodiment, the one or more locations are predetermined.

In an embodiment, the autonomous downhole tool 755 self-activates one or more functional components of the tool 755 at a sensed location in the well bore 120 without receiving command communications from an external source. By way of example, in an embodiment, the tool 755 brakes to self-stop, then self-activates to seal off a portion of the well bore 120, such as, for example, to temporarily seal off a portion of the well bore 120 for well servicing, or to permanently seal off a portion of the well bore 120 to abandon the well. In another embodiment, the tool 755 brakes to self-slow or self-stop, then self-activates to create perforations through the casing 125 and into the formation F. In another embodiment, the tool 755 brakes to self-stop, then self-activates to rotate to a desired azimuth orientation and set against the casing 125 or a well bore wall. In another embodiment, the tool 755 brakes to self-slow, then self-activates the spacing component 900 to adjust its length as the tool 755 approaches a target location within the well bore 120. In an embodiment, the length of the spacing component 900 is adjusted via inertial force in response to the braking action. For example, the spacing component 900 extends via inertial force when the braking system 760 is activated. In an embodiment, the spacing component 900 extends and then locks into the extended position. In an embodiment, the lock is releasable. As one of ordinary skill in the art will appreciate, autonomous downhole tools 755 may be employed to perform many other types of functions within the well bore 120.

In an embodiment, the autonomous downhole tool 755 releases a releasable component 800 of the tool 755. In an embodiment, the releasable component 800 is returned to the surface 105 via a mechanical connection to the surface 105, via buoyant action, via fluid circulation in the well bore 120, or a combination thereof. In an embodiment, the releasable component comprises a portion of the navigation system 756 or a separate logging device 850.

In an embodiment, after the tool 755 performs a function at the sensed location, the autonomous downhole tool 755 releases the brake to continue traversing the well bore 120. In an embodiment, the autonomous downhole tool 755 reactivates the brake to self-slow or self-stop at another sensed location in the well bore 120. In an embodiment, the autonomous downhole tool 755 self-activates again to perform the same function or one or more different functions at another location in the well bore 120.

In an embodiment, the autonomous downhole tool 755 remains in the well bore 120 permanently. In an embodiment, the autonomous downhole tool 755 is removable from the well bore 120.

After an autonomous downhole tool 755 has completed its intended function in the well bore 120, the tool 755, or a detachable component 800 or a spacing component 900 thereof, may be removed from the well bore 120. In an embodiment, the autonomous downhole tool 755 is retrievable. In a retrievable embodiment, the tool 755 may alter its buoyancy so that it floats to the surface 105 for retrieval. Alternately, the tool 755 may be flowable so that it flows to the surface 105 in a fluid flowing in the well bore 120 for retrieval. In another embodiment, the tool 755 may be retrieved via a connection to the surface 105, such as via cable 118. As one of ordinary skill in the art will understand, other retrieval methods, or a combination of retrieval methods may also be employed.

In another embodiment, the autonomous downhole tool 755 is disposable. In a disposable embodiment, the tool 755 may comprise drillable materials, millable materials, or both, such that the tool 755 is drilled or milled out of the well bore 120 after its service is complete. Alternately, the tool 755 comprises an effective amount of dissolvable material, such as an epoxy resin, a fiberglass, or a glass-reinforced epoxy resin, for example, such that the tool desirably decomposes when exposed to a chemical solution, an ultraviolet source, or a nuclear source. In another embodiment, the tool 755 comprises an effective amount of biodegradable material such that the tool desirably decomposes over time when exposed to a well bore 120 environment. Suitable biodegradable materials are disclosed in copending U.S. patent application Ser. No. 10/803,689, filed on Mar. 17, 2004, entitled "Biodegradable Downhole Tools", and copending U.S. patent application Ser. No. 10/803,668, filed on Mar. 17, 2004, entitled "One-Time Use Composite Tool Formed of Fibers and a Biodegradable Resin", as previously referred to herein.

Figures 13A, 13B, 13C, 13D:
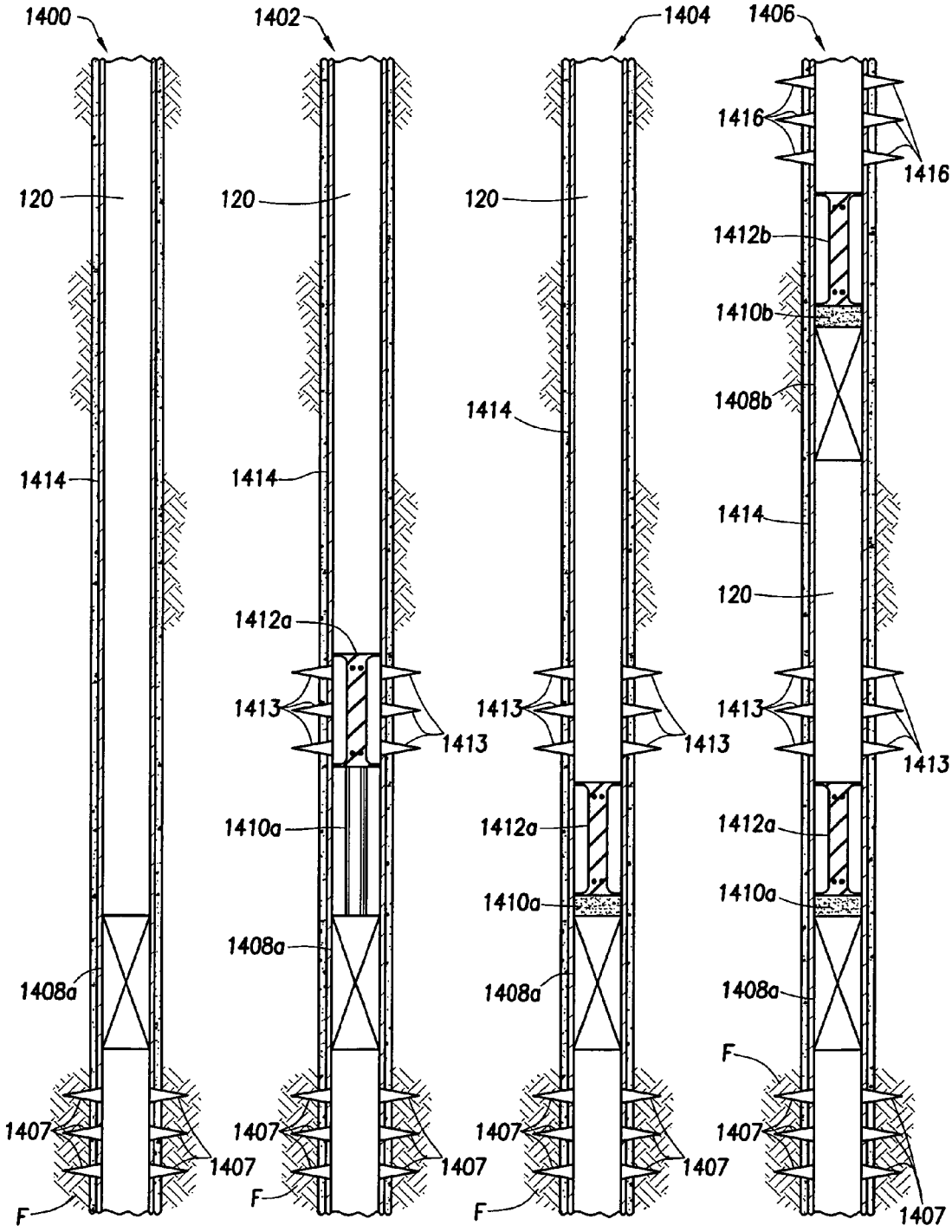
FIG. 13 is a cross-sectional view of four stages of a method for performing a fracturing well service job using autonomous downhole tools.

Turning now to FIGS. 13A, 13B, 13C, and 13D, four stages of a method for performing a fracturing well service job using at least one autonomous downhole tool is depicted. Referring now to FIG. 13A, a well bore configuration 1400 depicts a first autonomous zonal isolation device 1408*a* set against the casing 1414 to isolate the well bore zone below the device 1408*a*. In an embodiment, a first set of perforations 1407 has been made through a casing 1414 and into the formation F so that the zone below the device 1408*a* can be produced through the perforations 1407. In alternate embodiments, the device 1408*a* is set for another reason, such as to limit the quantity of service fluid required in the well bore 120 above the device 1408*a*, and therefore, no perforations 1407 are required below the device 1408*a*.

To set the first autonomous zonal isolation device 1408*a*, the device 1408*a* is initially deployed along at least a partial length of the well bore 120 via an external force. In particular, in various embodiments, the first autonomous zonal isolation device 1408*a* is lowered into the well bore 120 on a cable 118 as shown in FIG. 1, pumped into the well bore 120 as shown in FIG. 2, released into the well bore 120 to descend by force of gravity as shown in FIG. 3, or a combination thereof. In an embodiment, the first autonomous zonal isolation device 1408*a* is self-navigating, i.e. the device 1408*a* is operable to self-determine its location as it traverses the well bore 120. In an embodiment, as the first zonal isolation device 1408*a* approaches the location where it will set, for example, a predetermined location identified in a mission program 767, the first zonal isolation device 1408*a* self-activates a brake 760, as previously described herein, to slow the device 1408*a*. In an embodiment, when the first zonal isolation device 1408*a* arrives at the predetermined location, the device 1408*a* self-activates to set against the casing 1414 and thereby seal the well bore 120 without command communications from the surface 105.

In an embodiment, the first zonal isolation device 1408*a* comprises a navigation system 756, and the navigation system 756, or a portion thereof, is releasable for recovery to the surface 105, either through buoyant action or via fluid circulating in the well bore 120. In an alternate embodiment, a separate logging device 850 may be coupled to the top of the first zonal isolation device 1408*a*. In this embodiment, the logging device 850 may be released to return to the surface 105, either through buoyant action or via fluid circulating in the well bore 120, for example.

In another embodiment, the separate logging device 850 is separately deployed into the well bore 120 to engage the set device 1408*a* and verify its location, then return to the surface 105. In an embodiment, the separately deployed logging device 850 comprises a variable buoyancy body such that the device 850 descends in the well bore 120 via gravity to engage the set device 1408*a*, and then alters its buoyancy to ascend in the well bore 120 through buoyant action. In another embodiment, the separately deployed logging device 850 is flowable such that the device descends and ascends by flowing in a fluid being circulated in the well bore 120.

In another embodiment, the separate logging device 850 is attached to the isolation device 1408*a* and deployed therewith into the well bore 120. After the isolation device 1408*a* is set, the logging device 850 is selectively detached from the isolation device 1408*a* and returned to the surface 105 via buoyant action or fluid circulation. Thereafter, the same logging device 850 may be separately deployed into the well bore 120 via gravity or fluid circulation to engage the set device 1408*a* to verify its location, and then return to the surface 105 again via buoyant action or fluid circulation.

The various embodiments of the logging device 850 may collect logging information, such as information about properties of the well bore 120, during descent into the well bore 120, during ascent out of the well bore 120, or both. The logging information may be retrieved from the logging device 850 at the surface 105.

Referring now to FIG. 13B and to well bore configuration 1402, a method for using a first perforating gun 1412*a* to create a second set of perforations 1413 through the casing 1414 and into the formation F beyond is depicted. In an embodiment, after the first zonal isolation device 1408*a* is set against the casing 1414, a first releasable spacing component 1410*a* and the first perforating gun 1412*a* are deployed into the well bore 120. The first releasable spacing component 1410*a* may be coupled to the bottom of the first perforating gun 1412*a* , or it may be provided as a separate component. In an alternate embodiment, the first releasable spacing component 1410*a* may have been coupled to the top of the first zonal isolation device 1408*a* and deployed therewith into the well bore 120.

The first releasable spacing component 1410*a* and the first perforating gun 1412*a* are either pumped or dropped into the well bore 120 to free-fall by force of gravity, or both, until the first releasable spacing component 1410*a* is stopped by contact with the first zonal isolation device 1408*a*, and the first perforating gun 1412*a* is stopped by contact with the first releasable spacing component 1410*a*. The first releasable spacing component 1410*a* has a sufficient length to position the first perforating gun 1412*a* at a desirable location to create perforations 1413 through the well bore casing 1414 and into the formation F. Alternatively, the first perforating gun 1412*a* may be deployed into the well bore 120 to engage the first zonal isolation device 1408*a* directly without having the first spacing component 1410*a* therebetween. The first perforating gun 1412*a* fires in response to the deceleration of the gun 1412*a*, in response to an expired on-board timer, in response to another triggering means, or a combination of these or other known arming or safety methods.

Referring now to FIG. 13C and to well bore configuration 1404, the first releasable spacing component 1410*a* has been reduced in length to lower the first perforating gun 1412*a* substantially clear of the second set of perforations 1413. Sometime during or after the first perforating gun 1412*a* fires, the first releasable spacing component 1410*a* may dissolve due to the presence of a dissolving fluid introduced for this purpose into the well bore 120 so as to collapse. In other embodiments, the spacing component 1410*a* folds, bends, buckles, fragments, or bums away, as previously described herein, during or after the first perforating gun 1412*a* fires.

Regardless of the method for reducing the length of the releasable spacing component 1410*a*, the reduced length releasable spacing component 1410*a* does not block production fluids from flowing up the well bore 120. In various embodiments where debris of the releasable spacing component 1410*a* remains, such debris may have a high permeability to allow flow therethrough, or the debris may be circulated out of the well bore 120 by the production fluids, or the debris may be dissolvable in the production fluids, for example.

In an alternative embodiment, a spacing component 1410*a* is not provided, and the first perforating gun 1412*a* has an adjustable length. In various embodiments, the perforating gun 1412*a* may be collapsible, foldable, bendable, buckleable, frangible, dissolvable, degradable, combustible, or a combination thereof, similar to the various embodiments of the spacing component 1410*a*. Thus, the first perforating gun 1412*a* may be moved clear or substantially clear of the second set of perforations 1413 by being retrieved to the surface 105, or by being at least partially collapsed, folded, bent, buckled, fractured, dissolved, degraded, burned away, or a combination thereof.

Figure 14:
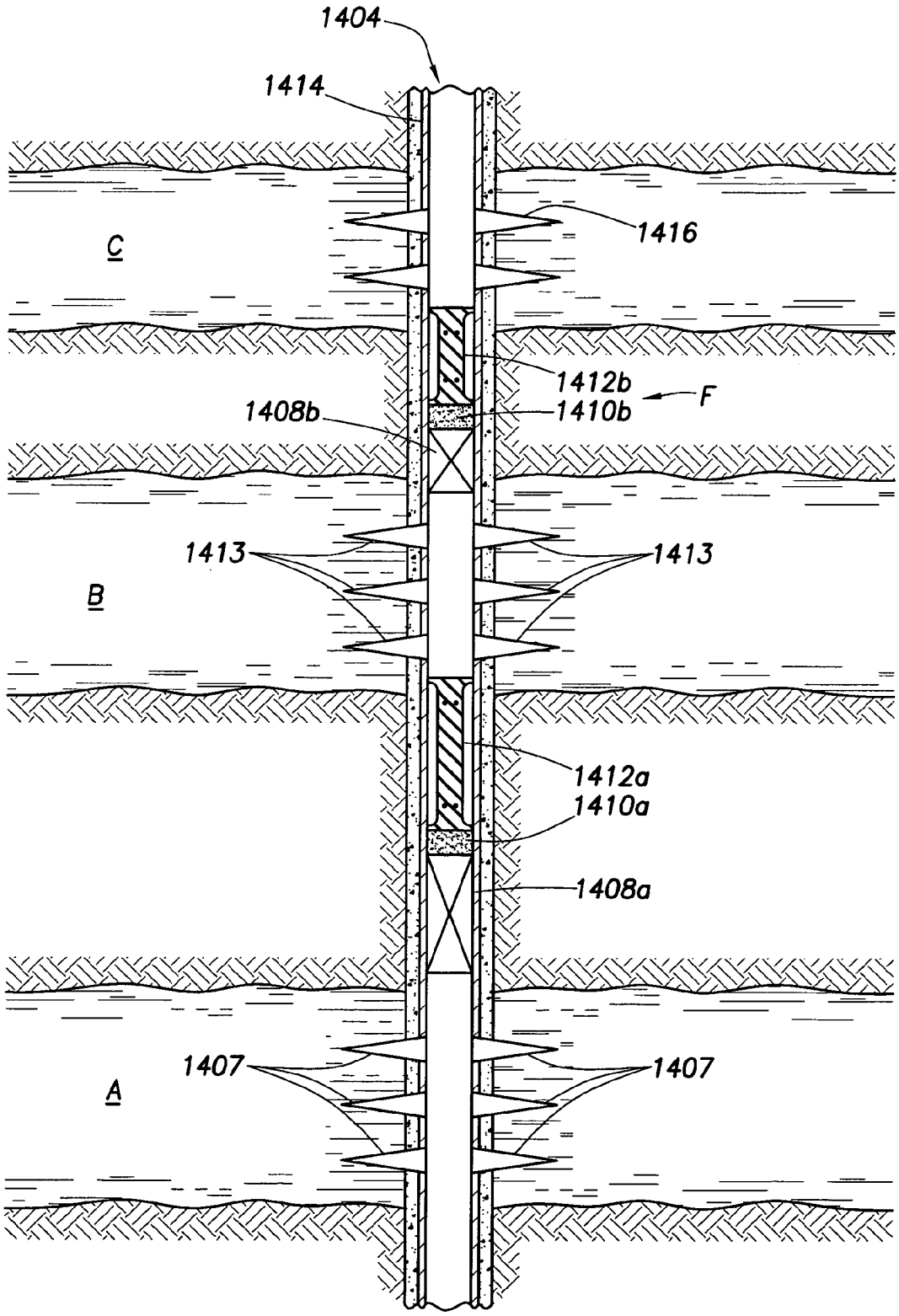
FIG. 14 is a cross-sectional view of a frac plug and a perforating gun disposed between each production zone in a hydrocarbon formation.

After the second set of perforations 1413 is created, a fracturing fluid may be introduced into the well bore 120 for purposes of fracturing the formation F through the second set of perforations 1413. In more detail, referring now to FIG. 14, the third well bore configuration 1404 is shown in the context of a formation F containing a zone A, a zone B, and a zone C. In operation, the zonal isolation device 1408*a* may be used in a well stimulation/fracturing operation to isolate the zone A below the zonal isolation device 1408*a*. Stimulation fluid may be introduced into the well bore 120, such as by lowering a tool into the well bore 120 for discharging the stimulation fluid at a relatively high pressure or by pumping the fluid directly into the well bore 120. The stimulation fluid then passes through the perforations 1413 into the zone B, a producing zone of formation F, for stimulating the recovery of fluids in the form of oil and gas containing hydrocarbons. These production fluids pass from the zone B, through the perforations 1413, and up the well bore 120 for recovery at the surface 105, such as at a well head. As previously described, the zonal isolation device 1408*a* provides a check valve function whereby fluid flow may not pass downwardly but may pass upwardly through the zonal isolation device 1408*a*. In this case, after completion of the stimulation job, and after the pressure of the stimulation fluid has dropped sufficiently, production fluids from the zone A may flow upwardly through the zonal isolation device 1408*a* and join with the production fluids from zone B, to flow up the well bore 120 for recovery at the surface 105, such as at the well head.

Referring to FIG. 13D, a fourth well bore configuration 1406 is depicted in which a second zonal isolation device 1408*b* has been set, and a second releasable spacing component 1410*b* along with a second perforating gun 1412*b* have been deployed to create a third set of perforations 1416. The fourth well bore configuration 1406 depicts the method after the second perforating gun 1412*b* has created the third set of perforations 1416 in the well bore casing 1414 and the second releasable spacing component 1410*b* has reduced in length. The process whereby the second zonal isolation device 1408*b*, the second releasable spacing component 1410*b*, and the second perforating gun 1412*b* are deployed into the well, set and fired may be the same as or similar to the process described above for the first zonal isolation device 1408*a*, the first releasable spacing component 1410*b*, and the first perforating gun 1412*b*.

Referring again to FIG. 14, a typical stimulation job may be conducted to stimulate the recovery of fluids in the form of oil and gas containing hydrocarbons through the third set of perforations 1416 from the zone C, for example. These production fluids pass from the zone C, through the perforations 1416, and up the well bore 120 for recovery at the surface 105, such as at a well head. Again, the second zonal isolation device 1408*b* provides a check valve function whereby fluid flow may not pass downwardly but may pass upwardly through the device 1408*b*. In this case, after completion of the stimulation or fracturing job, and after the pressure of the stimulation fluid has dropped sufficiently, production fluids from zone A and zone B below the second zonal isolation device 1408*b* may flow upwardly through the device 1408*b* and join with the production fluids from zone C, and up the well bore 120 for recovery at the surface 105, such as at the well head.

Referring again to FIGS. 13, after the well fracturing operation is complete, the various tools may be removed from the well bore 120. In an embodiment, the first zonal isolation device 1408*a*, the second zonal isolation device 1408*b*, the first perforating gun 1412*a*, and the second perforating gun 1412*b* may be floated back to the surface via production fluid flow.

In an embodiment, the first zonal isolation device 1408*a*, the first perforating gun 1412*a*, the second zonal isolation device 1408*b*, and the second perforating gun 1412*b* may be drilled through using a drill bit and a drill string assembly.

In an embodiment, the zonal isolation devices 1408*a*, 1408*b* may self-activate to release from the casing 1414 and descend to the bottom of the well bore 120 by force of gravity or by pumping using servicing fluid. Alternately, the zonal isolation devices 1408*a*, 1408*b* may fully or partially dissolve, for example in the presence of a fluid pumped into the well bore 120 for this purpose, such that the devices 1408*a*, 1408*b* release from the casing 1414 and descend to the bottom of the well bore 120 by force of gravity or by pumping using servicing fluid.

Figure 15A:
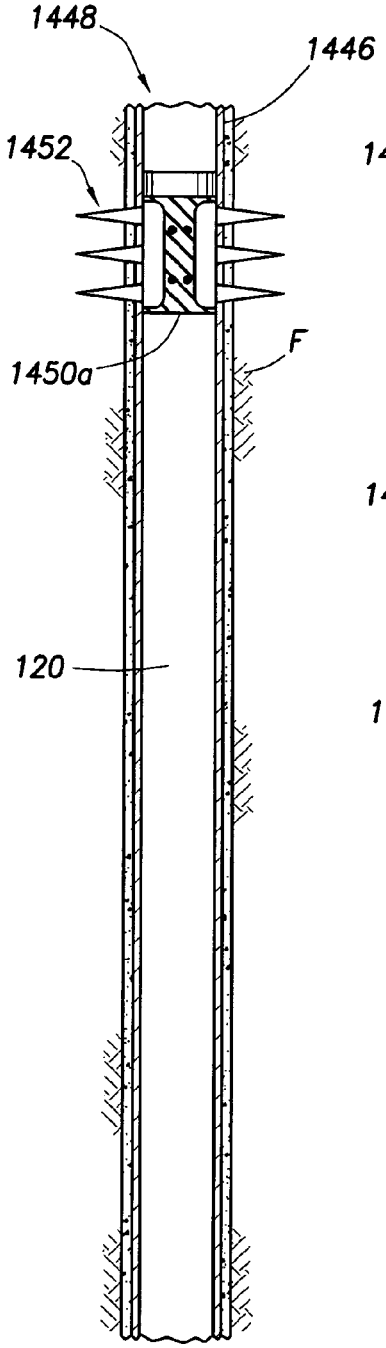
FIG. 15 is a cross-sectional view of three stages of a method for perforating a casing using more than one autonomous perforating gun.
Figure 15B:
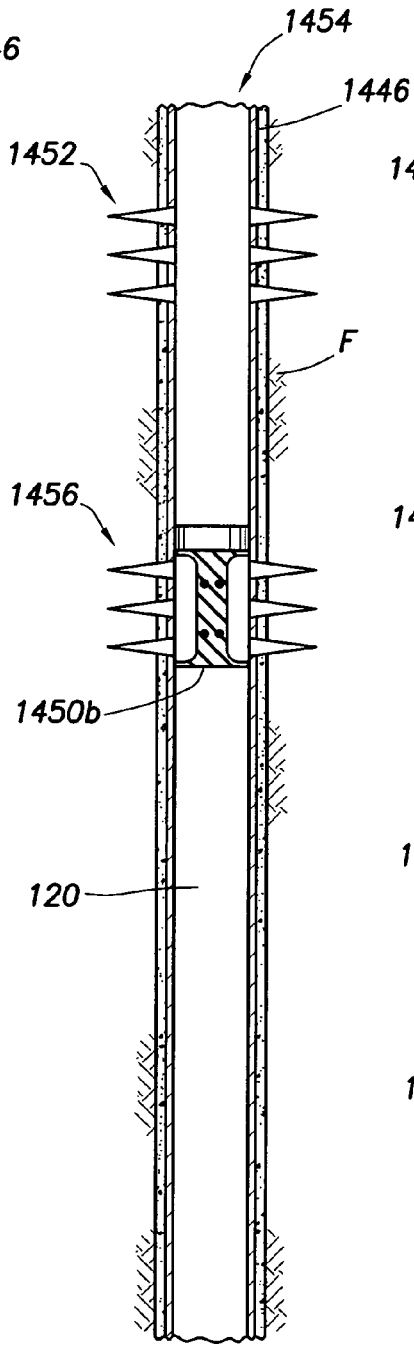
Figure 15C:
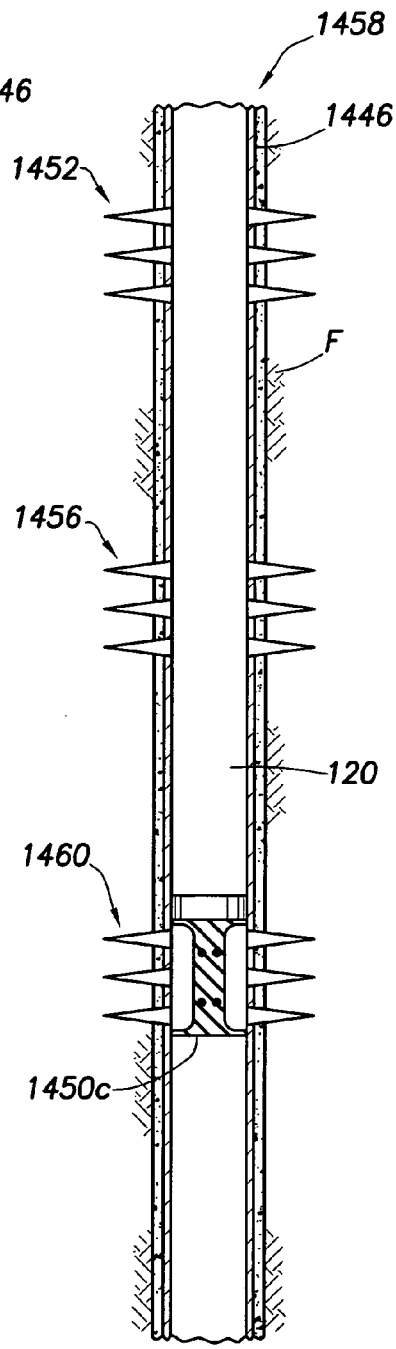

Turning now to FIGS. 15A, 15B, and 15C, a method of self-navigating and self-activating a plurality of autonomous perforating guns 1450*a*, 1450*b*, 1450*c* to create multiple sets of perforations 1452, 1456, 1460 in a well bore casing 1446 is depicted. Referring to FIG. 15A and to well bore configuration 1448, a first autonomous perforating gun 1450*a* is shown making a first set of perforations 1452 through the casing 1446 and into the formation F beyond.

The perforating gun 1450*a* is deployed into the well bore 120 via an external force, and the gun 1450*a* is operable to self-determine its location within the well bore 120. In an embodiment, the gun 1450*a* is deployed into the well bore by force of gravity or by being pumped into the well bore 120 in a fluid being circulated in the well bore 120, or both. In an embodiment, the gun 1450*a* is operable to self-fire perforating charges at predetermined locations within the well bore 120 to perforate the well bore casing 1446. In an embodiment, as the perforating gun 1450*a* approaches the predetermined location for creating the first set of perforations 1452, a braking system 760 is activated to slow the velocity of the perforating gun 1450*a*. Thus, when the perforating gun 1450*a* reaches the predetermined location, the perforating gun 1450*a* has sufficiently slowed or stopped before it self-fires perforating charges, thereby creating the first set of perforations 1452. The first perforating gun 1450*a* may then deactivate the brake and continue traversing the well bore 120 to descend to the bottom thereof, or may otherwise disintegrate or be removed from the well bore 120 by techniques described herein.

Referring now to FIG. 15B and to well bore configuration 1454, a second autonomous perforating gun 1450*b* is shown making a second set of perforations 1456 through the casing 1446 and into the formation F beyond. In an embodiment, as the second perforating gun 1450*b* approaches the predetermined location for creating the second set of perforations 1456, a braking system 760 is activated to slow the velocity of the perforating gun 1450*b*. Thus, when the perforating gun 1450*b* reaches the predetermined location, it has sufficiently slowed or stopped before it self-fires perforating charges, thereby creating the second set of perforations 1456. The perforating gun 1450 may then deactivate the brake and continue traversing the well bore 120 to descend to the bottom thereof, or may otherwise disintegrate or be removed from the well bore 120 by techniques described herein.

Referring now to FIG. 15C and to well bore configuration 1458, a third perforating gun 1450*c* is shown making a third set of perforations 1460 in the casing 1446 according to the same or similar methods employed to make the first and second sets of perforations 1452, 1456. In various embodiments, each of the perforating guns 1450*a*, 1450*b*, and 1450*c* may be disposed of, for example, by descending to the bottom of the well bore 120, or each of the perforating guns 1450*a*, 1450*b*, and 1450*c* may be retrieved to the surface 105, such as by altering its buoyancy so that it floats to the surface 105, for example.

Figures 16A, 16B, 16C:
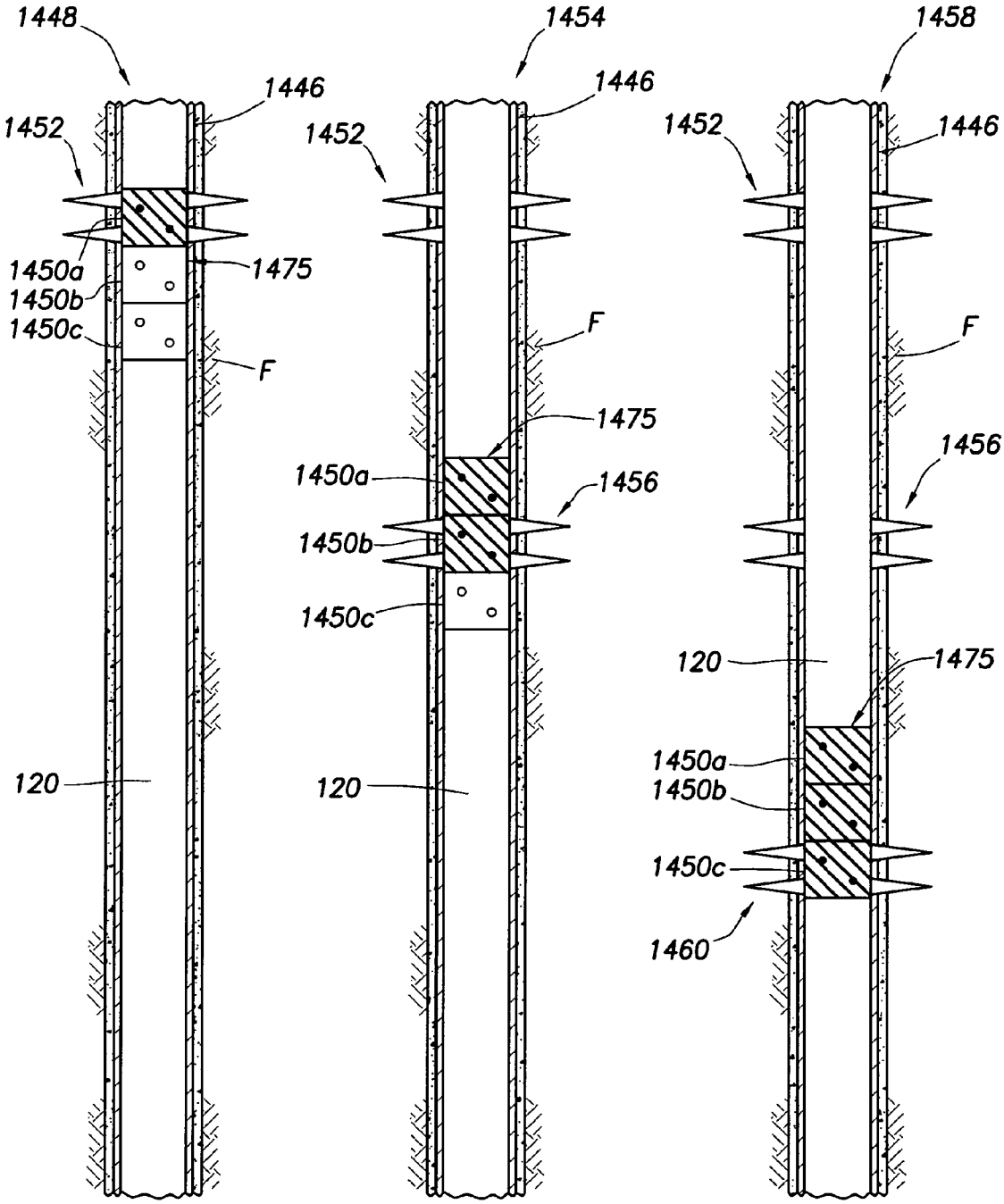
FIG. 16 is a cross-sectional view of three stages of a method for perforating a casing using an autonomous downhole tool comprising a plurality of perforating guns.

Turning now to FIGS. 16A, 16B, and 16C, in an alternative method, an autonomous downhole tool 1475 comprising a string of perforating guns 1450*a*, 1450*b*, 1450*c* may be used to create multiple sets of perforations 1452, 1456, 1460 in a well bore casing 1446. The autonomous downhole tool 1475 is deployed into the well bore 120 via an external force, and is operable to self-determine its location within the well bore 120. In an embodiment, the autonomous downhole tool 1475 is deployed into the well bore 120 by force of gravity or by being pumped into the well bore 120 in a fluid being circulated in the well bore 120, or both. In an embodiment, the autonomous downhole tool 1475 is operable to self-fire perforating charges from one or more of the perforating guns 1450*a*, 1450*b*, 1450*c* at predetermined locations within the well bore 120 to perforate the well bore casing 1446.

Referring to FIG. 16A and to well bore configuration 1448, an upper perforating gun 1450*a* of the autonomous downhole tool 1475 is shown making a first set of perforations 1452 through the casing 1446 and into the formation F beyond. In an embodiment, as the autonomous downhole tool 1475 approaches the predetermined location for creating the first set of perforations 1452, a braking system 760 is activated to slow the velocity of the tool 1475. Thus, when the upper perforating gun 1450*a* reaches the predetermined location, the tool 1475 has sufficiently slowed or stopped before the upper perforating gun 1450*a* self-fires perforating charges, thereby creating the first set of perforations 1452. The braking system 760 may then be deactivated so that the autonomous downhole tool 1475 may continue traversing the well bore 120.

Referring now to FIG. 16B and to well bore configuration 1454, a middle perforating gun 1450*b* is shown making a second set of perforations 1456 through the casing 1446 and into the formation F beyond. In an embodiment, as the autonomous downhole tool 1475 approaches the predetermined location for creating the second set of perforations 1456, a braking system 760 is activated to slow the velocity of the tool 1475. Thus, when the middle perforating gun 1450*b* reaches the predetermined location, the tool 1475 has sufficiently slowed or stopped before the middle perforating gun 1450*b* self-fires perforating charges, thereby creating the second set of perforations 1456. The braking system 760 may then be deactivated so that the autonomous downhole tool 1475 may continue traversing the well bore 120.

Referring now to FIG. 16C and to well bore configuration 1458, a lower perforating gun 1450*c* is shown making a third set of perforations 1460 in the casing 1446 according to the same or similar methods employed to make the first and second sets of perforations 1452, 1456. In various embodiments, the autonomous downhole tool 1475 may be disposed of, for example, by descending to the bottom of the well bore 120, or the tool 1475 may be retrieved to the surface 105, such as by altering its buoyancy so that it floats to the surface 105, for example. 100176 The foregoing descriptions of specific embodiments of an autonomous tool 100, 755, 1408, 1450, 1475 and the systems and methods for servicing a well bore 120 using such tools 100, 755, 1408, 1450, 1475 have been presented for purposes of illustration and description and are not intended to be exhaustive or to limit the invention to the precise forms disclosed. Obviously many other modifications and variations are possible. In particular, the type of autonomous downhole tool, the particular components that make up the downhole tool, or the type of well servicing method could be varied.

While various embodiments of the invention have been shown and described herein, modifications may be made by one skilled in the art without departing from the spirit and the teachings of the invention. The embodiments described here are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

What is claimed is:

1. A method of servicing a well bore comprising:

deploying into the well bore a zonal isolation device operable to self-set at a sensed location;

self-setting the zonal isolation device to hold at the sensed location without receiving command communications from the surface;

deploying a perforating gun into the well bore after the device is set;

firing the gun to form a set of perforations; and pumping a servicing fluid down the well bore to a location above the set device;

wherein:

the zonal isolation device is deployed along at least a partial length of the well bore via an external force;

the device seals the well bore at the sensed location;

the servicing fluid is a fracturing fluid;

the fracturing fluid enters and fractures a formation via the set of perforations in the well bore; and wherein deployment of the gun is stopped when a spacing component engages both the set device and the perforating gun.

2. The method of claim 1 wherein the spacing component projects from the bottom of the perforating gun, and wherein deployment of the gun is stopped in response to contact between the spacing component and the set device.

3. The method claim 1 wherein the spacing component projects from the top of the set device, and wherein deployment of the gun is stopped in response to contact between the spacing component and the gun.

4. The method of claim 1 further comprising releasing the spacing component into the well bore before deploying the perforating gun into the well bore.

5. The method of claim 1 further comprising at least partially collapsing, folding, bending, buckling, fragmenting, dissolving, burning away, or combinations thereof the spacer rod during or after firing the gun to lower the gun with respect to the set of perforations.

6. The method of claim 5 further comprising:

deploying into the well bore a second zonal isolation device operable to self-set at a second sensed location above the set of perforations; and self-setting the second device to seal the well bore at the second sensed location.

7. The method of claim 6 wherein the second device is operable to identify the second sensed location without receiving communications from the surface.

8. The method of claim 6 further comprising:

deploying a second perforating gun into the well bore after the second device is set; and firing the gun to form another set of perforations in the well bore.

9. The method of claim 8 wherein the second perforating gun is deployed by dropping the gun down the well bore via gravity, pumping the gun down the well bore, or a combination thereof.

10. The method of claim 8 wherein deployment of the second gun is stopped when a second spacing component engages both the second set device and the second perforating gun.

11. The method of claim 10 further comprising at least partially collapsing, folding, bending, buckling, fragmenting, dissolving, burning away, or combinations thereof the second spacing component during or after firing the second gun to lower the second gun with respect to the another set of perforations.

* * * * *